US008735041B2

(12) United States Patent
Kamoto et al.

(10) Patent No.: US 8,735,041 B2
(45) Date of Patent: May 27, 2014

(54) METHOD FOR PRODUCING RESIN-COATED CARRIER, RESIN-COATED CARRIER, TWO-COMPONENT DEVELOPER, DEVELOPING DEVICE, IMAGE FORMING APPARATUS AND IMAGE FORMING METHOD

(75) Inventors: Takanori Kamoto, Osaka (JP); Takayuki Yamanaka, Osaka (JP); Osamu Wada, Osaka (JP); Tadashi Iwamatsu, Osaka (JP); Nobuyuki Yoshioka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 743 days.

(21) Appl. No.: 12/730,583

(22) Filed: Mar. 24, 2010

(65) Prior Publication Data

US 2010/0248116 A1 Sep. 30, 2010

(30) Foreign Application Priority Data

Mar. 25, 2009 (JP) ..... P2009-075234
Feb. 9, 2010 (JP) ..... P2010-027023

(51) Int. Cl.
*G03G 9/10* (2006.01)

(52) U.S. Cl.
USPC ..... 430/111.32; 430/106.1; 430/110.2; 430/137.13

(58) Field of Classification Search
USPC ..... 430/110.2, 111.1, 48, 111.2, 111.35
See application file for complete search history.

(56) References Cited

U.S. PATENT DOCUMENTS

| | | | | |
|---|---|---|---|---|
| 4,518,674 | A * | 5/1985 | Watanabe et al. | 430/111.34 |
| 5,108,862 | A | 4/1992 | Kishimoto et al. | |
| 5,512,402 | A | 4/1996 | Okado et al. | |
| 5,885,742 | A * | 3/1999 | Okado et al. | 430/111.1 |
| 5,998,076 | A | 12/1999 | Mahabadi et al. | |
| 7,566,519 | B2 | 7/2009 | Kobayashi et al. | |
| 2006/0172218 | A1* | 8/2006 | Giannetto et al. | 430/111.32 |
| 2006/0246369 | A1* | 11/2006 | Pattison et al. | 430/111.35 |

(Continued)

FOREIGN PATENT DOCUMENTS

| | | |
|---|---|---|
| CN | 101105652 A | 1/2008 |
| JP | 2-220068 | 9/1990 |

(Continued)

OTHER PUBLICATIONS

Notice of Allowance mailed Jun. 19, 2012 in U.S. Appl. No. 12/769,121.

*Primary Examiner* — Mark F Huff
*Assistant Examiner* — Rashid Alam
(74) *Attorney, Agent, or Firm* — Nixon & Vanderhye P.C.

(57) ABSTRACT

A method for producing a low density resin-coated carrier having a small resin amount to a carrier core material and having a uniform resin coating layer formed on the carrier core material is provided. A resin-coated carrier has a carrier core material and a resin coating layer formed on the surface of the carrier core material. The carrier core material has pores and an apparent density of 1.6 g/cm$^3$ to 2.0 g/cm$^3$ and a remanent magnetization of 10 emu/g of less. The resin coating layer is formed by a dry process of adhering resin particles to a surface of the carrier core material and applying heat and impact force to the resin particles. A volume average particle size of the resin particles is less than 1 μm. A two-component developer containing the resin-coated carrier is charged in a developing device in an image forming apparatus, and an image is formed.

3 Claims, 7 Drawing Sheets

(56) References Cited

U.S. PATENT DOCUMENTS

| | | | | |
|---|---|---|---|---|
| 2006/0269862 | A1* | 11/2006 | Kobayashi et al. | 430/111.31 |
| 2007/0243482 | A1* | 10/2007 | Yamaguchi et al. | 430/111.35 |
| 2008/0014514 | A1 | 1/2008 | Kamoto | |
| 2009/0061333 | A1* | 3/2009 | Matsumoto et al. | 430/48 |
| 2009/0087771 | A1* | 4/2009 | Sawada et al. | 430/110.2 |
| 2009/0239173 | A1 | 9/2009 | Kobayashi et al. | |

FOREIGN PATENT DOCUMENTS

| | | |
|---|---|---|
| JP | 3-192268 | 8/1991 |
| JP | 4-86749 | 3/1992 |
| JP | 7-98521 | 4/1995 |
| JP | 2006-337579 | 12/2006 |
| JP | 2007-57943 | 3/2007 |
| JP | 2008-65106 | 3/2008 |
| JP | 2008-209725 | 9/2008 |
| JP | 2009-258595 | 11/2009 |

* cited by examiner

METHOD FOR PRODUCING RESIN-COATED CARRIER, RESIN-COATED CARRIER, TWO-COMPONENT DEVELOPER, DEVELOPING DEVICE, IMAGE FORMING APPARATUS AND IMAGE FORMING METHOD

CROSS-REFERENCE TO RELATED APPLICATION

This application claims priority to Japanese Patent Application No. 2009-075234, which was filed on Mar. 25, 2009, and No. 2010-027023, which was filed on Feb. 9, 2010, the contents of which are incorporated herein by reference in their entirety.

BACKGROUND OF THE INVENTION

1. Field of the Invention

The present invention relates to a method for producing a resin-coated carrier used in electrophotography in which a latent image formed on an image bearing member is developed into a visible image, a two-component developer containing the resin-coated carrier, a developing device using the two-component developer, an image forming apparatus, and an image forming method.

2. Description of the Related Art

Office automation (abbreviated as "OA") equipments have been remarkably developed in these days and in line with such development, there has been a wide spread copiers, printers, facsimile machines, and the like machines which form images through electrophotography.

For example, an image is formed by way of a charging step, an exposing step, a developing step, a transferring step, a fixing step, and a cleaning step in an image forming apparatus which employs electrophotography. At the charging step, a surface of a photoreceptor serving as an image bearing member is evenly charged in a dark place. At the exposing step, the charged photoreceptor receives signal light derived from a document image, resulting in removal of charges on the exposed part of the photoreceptor whose surface thus bears an electrostatic image (an electrostatic latent image). At the developing step, an electrostatic-image-developing toner (hereinafter simply referred to as "toner" unless otherwise mentioned) is supplied to the electrostatic image on the surface of the photoreceptor, thereby forming a toner image (a visualized image). At the transferring step, the toner image on the surface of the photoreceptor is transferred onto the recording medium by providing the recording medium with charges of which polarity is opposite to that of charges of the toner. At the fixing step, the toner image is fixed on the recording medium by heat, pressure, or the like. At the cleaning step, the toner is collected which has not been transferred onto the recording medium and thus remains on the surface of the photoreceptor. Through the above steps, a desired image is formed by the image forming apparatus employing electrophotography.

A usable developer for developing an electrostatic image in the image forming apparatus employing electrophotography includes a one-component developer containing only a toner and a two-component developer containing toner and carrier. The two-component developer is provided with functions of stirring, conveying, and charging toner by the carrier. Accordingly, since toner in two-component developer does not need to have functions of carrier, the two-component developer has characteristics that the controllability is improved due to such separation of the functions, and a high-quality image is easily obtained, compared with one-component developer containing toner solely. Therefore, a lot of development and research have been conducted with respect to toner suitable for use in combination with carrier.

A carrier has two fundamental functions: the function of stably charging a toner to a desired charge level, and the function of conveying a toner to a photoreceptor. Furthermore, a carrier is stirred in a developing tank, and borne onto a magnet roller, on which the carrier forms a magnetic brush. Subsequently, the carrier passes through a regulating blade, and then returns to the inside of the developing tank. This allows the carrier to be reused. In continuing use of the carrier, the carrier is required to stably realize the fundamental functions, particularly the function of stably charge a toner. However, the carrier generally has large density and large stirring torque. Therefore, much driving power is required to stir the carrier in a developing tank.

In recent years, in view of environment, improvement in a carrier relating to low power consumption of an image forming apparatus is developed, and many investigations to decrease a density of the carrier are conducted to achieve low power consumption by reducing stirring torque of a developing tank. Furthermore, a carrier having low density tends to be investigated in the standpoint of long life of a carrier. To realize low density of a carrier, it is important to decrease density of a core material itself of the carrier.

For the purpose of solving the above problems, Japanese Unexamined Patent Publications JP-A 2-220068 (1990), JP-A 3-192268 (1991) and JP-A 4-86749 (1992) disclose a magnetic powder-dispersed resin carrier that tried to decrease its density by using a comparatively small ferromagnetic substance and incorporating the substance into a thermal crosslinking resin.

JP-A 2006-337579 and JP-A 2007-57943 disclose a carrier in which pores of a carrier core material having pores therein (hereinafter referred to as a "porous type") are filled with a resin to decrease a density, and the surface of the carrier core material is coated with a silicone resin.

However, the magnetic powder-dispersed resin carriers disclosed in JP-A 2-220068, JP-A 3-192268 and JP-A 4-86749 are that because a magnetic substance used is a ferromagnetic substance, residual magnetization is large, adhesion by magnetic force is generated between carrier particles, and furthermore, a carrier is liable to remain on a magnet roller in the inside of a developing tank. Therefore, those carriers give rise to the problem in stirring property.

The amount of a resin used to coat a carrier core material is generally about 2 parts by weight to the carrier core material. However, the carriers disclosed in JP-A 2006-337579 and JP-A 2007-57943 require the amount at least 10 parts by weight, and this is not realistic from the production standpoint. Specifically, costs required in the production of a carrier are increased with increasing the amount of a resin used. Furthermore, because the amount of a resin used is large, it is difficult to control a thickness of a resin coating film which coats the surface of a carrier core material filled with a resin. Where a resin is added in an amount such that pores of the carrier core material are sufficiently impregnated therewith, carrier particles are liable to be adhered each other, and a uniform resin coating film cannot be formed. The carriers disclosed in JP-A 2006-337579 and JP-A 2007-57943 are that a resin coating film is formed by a wet process. Thus, the carriers contain an organic solvent, and therefore, a stable resin coating film cannot be formed.

SUMMARY OF THE INVENTION

An object of the invention is to provide a method for producing a low density resin-coated carrier having a small resin amount to a carrier core material and having a uniform resin coating layer formed on the carrier core material.

Another object of the invention is to provide a resin-coated carrier that contains a carrier core material having sufficiently small apparent density and remanent magnetization, and can stably charge a toner and can stably form high definition and high quality image free of image defects such as fog, a two-component developer containing the resin-coated carrier, and a developing device, an image forming apparatus and an image forming method using the two-component developer.

The invention provides a method for producing a resin-coated carrier, comprising:

a coating step of forming a coating layer by mixing a carrier core material having pores an apparent density of 1.6 g/cm$^3$ or more and 2.0 g/cm$^3$ or less and a remanent magnetization of 10 emu/g or less, and resin particles having a volume average particle size of less than 1 μm, and applying impact force to the resulting mixture while stirring the mixture under heating, thereby adhering the resin particles to a surface of the carrier core material and forming a film of the resin particles.

According to the invention, the method for producing a resin-coated carrier includes the coating step. The coating step forms a coating layer by mixing a carrier core material having pores, an apparent density of 1.6 g/cm$^3$ or more and 2.0 g/cm$^3$or less and a remanent magnetization of 10 emu/g or less, and resin particles having a volume average particle size of less than 1 μm, and applying impact force to the resulting mixture while stirring the mixture under heating, thereby adhering the resin particles on a surface of the carrier core material and forming a film of the resin particles. Thus, by forming the coating layer on the surface of the carrier core material as above, a resin does not enter pores of the carrier core material. As a result, a low density resin-coated carrier having a small amount of a resin used relative to the resin core material and having a uniform coating layer formed on the carrier core material can be obtained.

Further, in the invention, it is preferable that the resin particles comprise first resin particles and second resin particles having a volume average particle size smaller than that of the first resin particles, and the coating step comprises:

a first coating step of obtaining a first resin particle-adhered carrier core material by mixing the carrier core material and the first resin particles and applying impact force to the resulting mixture while stirring the mixture under heating, thereby adhering the first resin particles to the surface of the carrier core material; and a second coating step of forming a coating layer by mixing the first resin particle-adhered carrier core material and the second resin particles and applying impact force to the resulting mixture while stirring the mixture under heating, thereby adhering the second resin particles to a surface of the first resin particle-adhered carrier core material and forming a film of the first resin particles and the second resin particles on the surface of the carrier core material.

According to the invention, the resin particles comprise the first resin particles and the second resin particles having a volume average particle size smaller than that of the first resin particles. The coating step comprises the first coating step and the second coating step. The first coating step obtains the first resin particle-adhered carrier core material by mixing the carrier core material and the first resin particles and applying impact force to the resulting mixture while stirring the mixture under heating, thereby adhering the first resin particles to the surface of the carrier core material. The second coating step forms the coating layer by mixing the first resin particle-adhered carrier core material and the second resin particles and applying impact force to the resulting mixture while stirring the mixture under heating, thereby adhering the second resin particles to a surface of the first resin particle-adhered carrier core material and forming a film of the first resin particles and the second resin particles on the surface of the carrier core material.

A plurality of pores having different diameter are formed on the surface of the carrier core material. However, by mixing the carrier core material and the first resin particles and applying impact force to the resulting mixture while stirring the mixture under heating at the first coating step, the first resin particles can be adhered to the surface of the carrier core material so as to clog pores having relatively large diameter present on the surface of the carrier core material. By mixing the first resin particle-adhered carrier core material and the second resin particles and applying impact force to the resulting mixture while stirring the mixture under heating at the second coating step, the second resin particles can be adhered to the surface of the carrier core material so as to clog pores having relatively small diameter present on the surface of the carrier core material. As a result, the resin particles do not enter the inside of the pores of the carrier core material, and a uniform coating layer can stably be formed.

Further, in the invention, it is preferable that the method includes an outermost shell layer formation step of forming an outermost shell layer by adhering third resin particles having a glass transition temperature higher than that of the resin particles used at the coating step and forming a film of the third resin particles as a step after the coating step.

According to the invention, the outermost shell layer formation step is included as a step after the coating step. At the outermost shell layer formation step, the third resin particles having a glass transition temperature higher than that of the resin particles used at the coating step are adhered to the coating layer and formed into a film, thereby forming an outermost shell layer.

In forming the outermost shell layer, a strong outermost shell layer having excellent heat resistance can be formed on the coating layer by using the third resin particles having a glass transition temperature higher than that of the resin particles used at the coating step. As a result, a strong resin-coated carrier having excellent heat resistance can be obtained.

Further, the invention provides a resin-coated carrier comprising a carrier core material and a resin coating layer formed on the surface of the carrier core material, the carrier core material having pores and an apparent density of 1.6 g/cm$^3$ or more and 2.0 g/cm$^3$ or less, and a remanent magnetization of 10 emu/g or less, the resin coating layer being formed by a dry process of adhering resin particles to a surface of the carrier core material, and applying heat and impact force to the resin particles, and the resin particles having a volume average particle size of less than 1 μm.

According to the invention, the resin-coated carrier has a carrier core material and a resin coating layer on the surface of the carrier core material. The carrier core material has pores and an apparent density of 1.6 g/cm$^3$ or more and 2.0 g/cm$^3$ or less, and a remanent magnetization of 10 emu/g or less. The resin-coated carrier containing a carrier core material having sufficiently small apparent density and remanent magnetization can reduce driving torque of a magnet roller or the like in the inside of a developing tank at the time of stirring the carrier, and this permits to save electric power. A toner and a resin-coated carrier are always stirred in a developing tank during the development. Where an apparent density is small, stirring stress applied to a resin-coated carrier and abrasion of a resin coating layer are reduced, and as a result, a resin-coated carrier that gives stabilized charge amount to a toner even though the number of printing is increased can be obtained.

The resin coating layer is formed by a dry process of adhering resin particles to a surface of a carrier core material and applying heat and impact force the resin powder. Therefore, a stable resin coating layer free of an organic solvent can be formed. Because the volume average particle size of the resin particles is less than 1 μm, sufficient impact force can be applied in adhering the resin particles to the surface of a carrier core material, and a uniform resin coating layer free of exposure of a carrier core material is formed.

The toner is stably charged by using a developer containing such a resin-coated carrier. As a result, a high quality image that can finely reproduce an image, has good color reproducibility and high image density and is free of image defects such as fog can stably be formed.

Further, in the invention, it is preferable that the carrier core material contains magnetic oxide and non-magnetic oxide having a true density of 3.5 g/cm$^3$ or less.

According to the invention, the carrier core material contains magnetic oxide and non-magnetic oxide having a true density of 3.5 g/cm$^3$ or less. This permits to decrease a density of the resin-coated carrier and to form a resin-coated carrier capable of reducing driving torque and stress at the time of stirring. As a result, electric power can be saved, abrasion of a resin coating layer can be reduced, and stabilized charge amount can be given to a toner even though the number of printing is increased.

In addition, in the invention, it is preferable that the magnetic oxide is soft ferrite.

According to the invention, the magnetic oxide is soft ferrite. The embodiment that the magnetic oxide is soft ferrite can form a resin-coated carrier having a small remanent magnetization and being easy to separate from a magnet roller and the like. As a result, stabilized charge amount can be given to a toner.

The invention provides a two-component developer comprising the resin-coated carrier mentioned above and a toner containing a binder resin and a colorant.

According to the invention, the two-component developer comprises the resin-coated carrier of the invention and a toner containing a binder resin and a colorant. The resin-coated carrier of the invention can give stabilized charge amount to a toner, and thereby a two-component developer having stabilized charge amount even though the number of printing is increased can be formed. Use of such a two-component developer can stably form a high quality image that can finely reproduce an image, has good color reproducibility and high image density and is free of image defects such as fog over a long period of time.

Further, the invention provides a developing device performing development using the two-component developer mentioned above.

According to the invention, the developing device performs development using the two-component developer of the invention. As a result, the development can be performed with a toner having stabilized charge amount even though the number of printing is increased, and a toner image having high definition and free of fog can stably be formed over a long period of time.

Further, the invention provides an image forming apparatus comprising:

the developing device mentioned above; and a transfer section including an intermediate transfer member on which a plurality of toner images having different colors are to be formed.

According to the invention, the image forming apparatus comprises the developing device, and a transfer section including an intermediate transfer member on which a plurality of toner images having different colors are to be formed. The developing device of the invention can stably form a toner image with high definition and free of fog over a long period of time. Therefore, even in the image forming apparatus of the invention including an intermediate transfer member and a mechanism that transfers a toner image twice, a high quality image that finely reproduces an image, has good color reproducibility and high image density and is free of image defects such as fog can stably be formed over a long period of time.

Further, the invention provides an image forming method comprising forming a multicolor image using the two-component developer mentioned above.

According to the invention, the image forming forms a multicolor image by the development using the two-component developer of the invention. The two-component developer of the invention is that the charge amount of a toner is stabilized even though the number of printing is increased. Therefore, a multicolor image having excellent image reproducibility including color reproducibility and having high definition and high image density can stably be formed over a long period of time.

In addition, in the invention, it is preferable that the transfer is conducted using an intermediate transfer method that forms a plurality of toner images having different colors on an intermediate transfer member.

According to the invention, the transfer is conducted using an intermediate transfer system that forms a plurality of toner images having different colors on an intermediate transfer member. When the two-component developer of the invention is used, charge amount of a toner is stabilized even though the number of printing is increased. As a result, even in the method of the invention in which a toner image is transferred twice using an intermediate transfer system, a high quality image that finely reproduces an image, has good color reproducibility and high image density, and is free of image defects such as fog can stably be formed over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
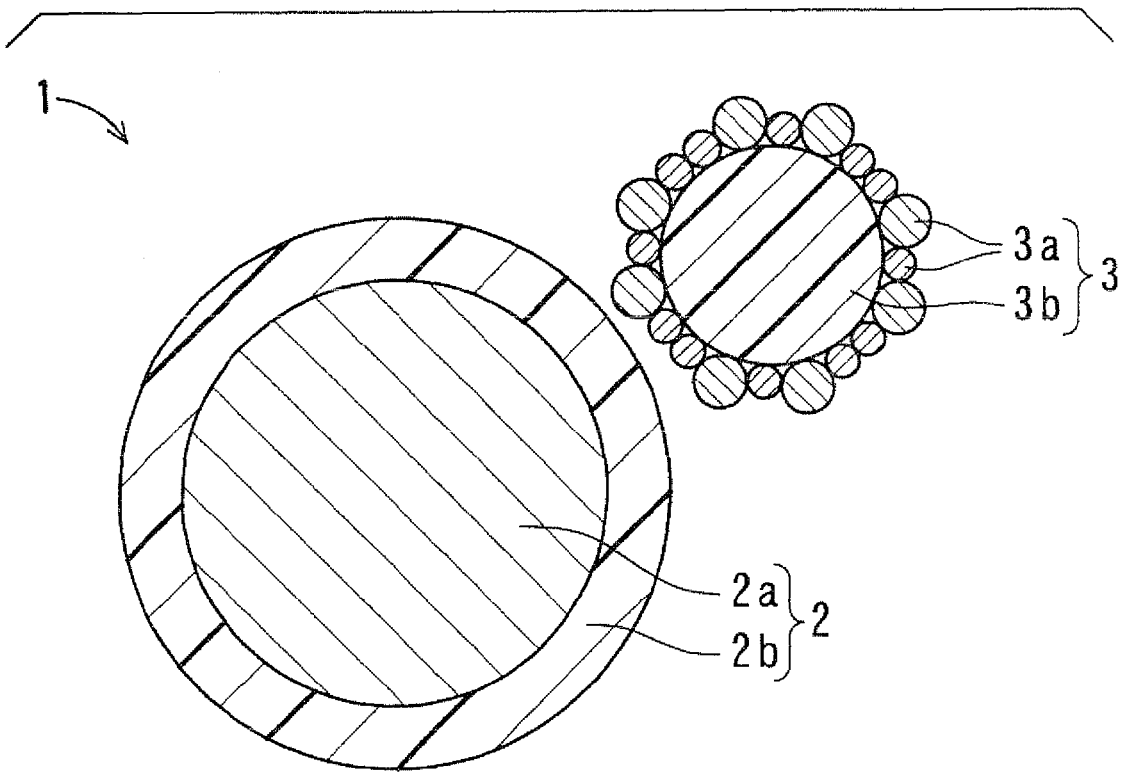
FIG. 1 is a sectional view schematically showing the constitution of a two-component developer of the invention.

Now referring to the drawings, preferred embodiments of the invention are described below.

1. Resin-Coated Carrier

<First Embodiment>

A resin-coated carrier according to a first embodiment of the invention comprises a carrier core material and a resin coating layer formed on the surface of the carrier core material. FIG. 1 is a sectional view schematically showing the constitution of the two-component developer 1 of the invention. A two-component developer 1 of the invention comprises a resin-coated carrier 2 of the embodiment and a toner 3. The resin-coated carrier 2 comprises a carrier core material 2*a* and a resin coating layer 2*b* formed on the surface of the carrier core material 2*a*. The constitution of the toner 3 will be described hereinafter.

[Carrier Core Material]

A carrier core material 2*a* forming the resin-coated carrier 2 of the embodiment has an apparent density of 1.6 g/cm$^3$ or more and 2.0 g/cm$^3$ or less, a remanent magnetization of 10 emu/g of less and a volume average particle size of from 25 μm to 50 μm. The resin-coated carrier 2 containing the carrier core material 2*a* having sufficiently small apparent density and remanent magnetization can reduce driving torque of a magnetic roller and the like in a developing tank during stirring the same, and therefore, this enables power saving. The toner 3 and the resin-coated carrier 2 are always stirred in a developing tank during the development. When the apparent density is small, stirring stress applied to the resin-coated carrier 2 and abrasion of a resin coating layer 2*b* are reduced. As a result, the resin-coated carrier 2 giving stabilized charge amount to the toner 3 even though the number of printing is increased can be obtained. The volume average particle size of the carrier core material 2*a* is from 25 μm to 50 μm. As a result, the resin-coated carrier 2 that can suppress adhesion of a carrier and can reduce driving torque can be obtained. Even when the apparent density of the carrier core material 2*a* is less than 1.6 g/cm$^3$, the above effect can be exhibited. However, considering durability of the resin-coated carrier 2, the apparent density of the carrier core material 2*a* is required to limit to 1.6 g/cm$^3$ or more.

The carrier core 2*a* can use the one commonly used in this field, and usable examples thereof include a magnetic metal such as iron, copper, nickel and cobalt; and a magnetic metal oxide such as ferrite and magnetite.

Ferrite as magnetic oxide is generally a group of iron oxides having the component of $MO.Fe_2O_3$. M includes divalent metal ions such as $Fe^{2+}$, $Mn^{2+}$, $Mg^{2+}$, $Co^{2+}$, $Ni^{2+}$, $Cu^{2+}$ and $Zn^{2+}$. The ferrite is obtained by mixing a powder of a metal oxide containing those divalent metal ions and a powder of iron oxide, compression forming the mixture, and firing the resulting molded article. The metal oxides may be used each alone, or two or more of them may be used in combination. When the metal oxide has a mixed component, controllable range of magnetic characteristics in the carrier core material 2*a* broadens.

When raw material of M is a metal oxide containing $Fe^{2+}$, $Fe_2O_3$ is preferred. When raw material of M is a metal oxide containing $Mn^{2+}$, $MnCO_3$ is preferred, but $Mn_3O_4$ and the like may be used. When raw material of M is a metal oxide containing $Mg^{2+}$, $MgCO_3$ and $Mg(OH)_2$ are preferred.

The ferrite includes soft ferrite showing soft magnetic properties and hard ferrite showing hard magnetic properties. In the embodiment, the magnetic oxide is preferably soft ferrite. Because hard ferrite is a magnet, the remanent magnetization is large. Where the magnetic oxide is hard ferrite, there are possibilities that resin-coated carrier particles adhere each other, thereby decreasing fluidity of the two-component developer 1, and the resin-coated carrier 2 is difficult to separate from a magnet roller. However, when the magnetic oxide is soft ferrite, the remanent magnetization can be decreased to 10 emu/g or less, fluidity of the two-component developer 1 becomes good, and the resin-coated carrier 2 which is easy to separate from a magnet roller and the like can be obtained.

A plurality of pores having different size are present on the surface of the carrier core material 2*a*. The diameter of those pores is preferably 0.1 μm or more and 1.0 μm or less.

The carrier core material 2*a* has relatively small density such that an apparent density is 1.6 g/cm$^3$ or more and 2.0 g/cm$^3$ or less. The carrier core material 2*a* can be made to have low density by, for example, forming pores inside the carrier core material 2*a*. Such a carrier core material 2*a* can be obtained by, for example, a resin addition method. The resin addition method will be described in detail hereinafter.

The carrier core material 2*a* can further be made to have low density by containing non-magnetic oxide having a true density of 3.5 g/cm$^3$ or less in the carrier core material 2*a* together with the magnetic oxide, and thereby a density of the resin-coated carrier 2 can be decreased. Specifically, silica is contained in the inside of the carrier core material 2*a* in place of forming pores in the carrier core material 2*a*. Such a method includes a silica particle addition method. For example, silica having a true density of around 2 g/cm$^3$ is contained in the carrier core material 2*a* together with ferrite having a true density of around 4.9 g/cm$^3$. The silica particle addition method will be described in detail hereinafter.

[Resin Coating Layer]

The resin coating layer 2*b* is formed on the surface of the carrier core material 2*a*. The resin coating layer 2*b* formed by a dry process of adhering resin particles to the surface of the carrier core material 2*a* and applying heat and impact force to the resin powder. Due to such a formation method, the resin coating layer 2*b* does not contain an organic solvent, and the stable resin coating layer 2*b* is formed. In a wet process, a resin coating layer is formed from the surface. Therefore, film formation proceeds remaining an organic solvent in the coating layer, and a stable resin coating layer is not formed. Where a two-component developer containing a resin-coated carrier prepared by a wet process and having an organic solvent remained in the inside of the resin coating layer is placed in a developing device, and stirred in the developing device, the temperature in the inside of the developing device is elevated, and as a result, the organic solvent may ooze from the resin coating layer of the resin-coated carrier. Where the organic solvent in the inside of the coated resin layer oozes, a main resin constituting a toner adhered on the surface of the resin-coated carrier dissolves, and the toner itself is deteriorated. Additionally, adhesion strength to the resin-coated carrier is increased, the amount of development to a photoreceptor is decreased, and deterioration of an image is induced by conveying defect due to decrease in fluidity of a developer. Furthermore, the problem on odor occurs. Conditions for the formation of the resin coating layer 2*b* by a dry process are described hereinafter. The resin particles used for the formation of the resin coating layer 2*b* are hereinafter referred to as "coating resin particles".

The resin coating layer 2*b* may include the conductive particles as the conductive materials. As the conductive particles, for example, oxide such as conductive carbon black, conductive titanium oxide, and tin oxide are used. Among the substances just cited, the conductive carbon black is preferred to develop, with a small amount thereof, sufficient conductivity. In the case of the use for a color toner, there is a concern about detachment of the carbon from the resin coating layer 2*b* of the resin-coated carrier 2. In this case, the antimony-doped conductive titanium oxide, and the like substance are used.

The thickness of the resin coating layer 2*b* is preferably 0.5 μm or more and 2.0 μm.

The volume average particle size of the resin-coated carrier 2 comprising the carrier core material 2*a* and the resin coating layer 2*b* formed on the surface of the carrier core material 2 is preferably from 25 μm to 50 μm. When the volume average particle size of the resin-coated carrier 2 is 25 μm or more, adhesion of a carrier is small, and high image quality can be achieved. When the volume average particle size of the resin-coated carrier 2 is 50 μm or less, toner retention capability of carrier particles is high, a solid image is uniform, and toner scattering and fog can be reduced.

In the resin-coated carrier 2 of the embodiment, in the case where the carrier core material 2*a* has pores, a resin does not enter the pores. Due to this, the amount of a resin used in the production can be decreased as compared with the resin-coated carrier 2 having a resin filled in pores, and adhesion between carrier particles due to a large amount of a resin used in the production can be suppressed. Furthermore, production costs can be decreased.

When the two-component developer 1 containing the resin-coated carrier 2 is used, the toner 3 can stably be charged. As a result, a high quality image that can finely reproduce an image, has good color reproducibility and high image density and is free of image defects such as fog can stably be formed.

Figure 2:
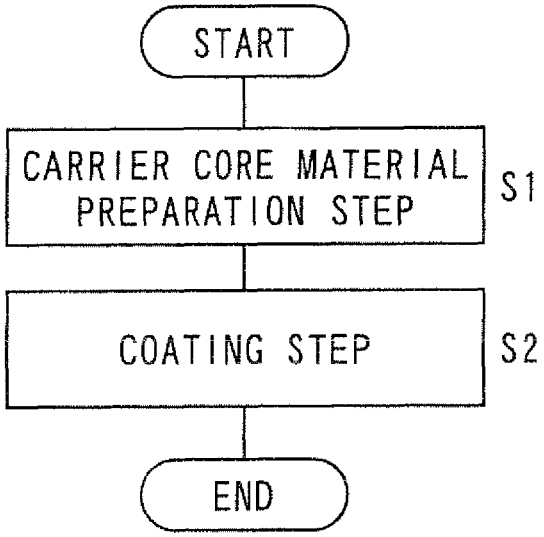
FIG. 2 is a process chart showing the production method of a resin-coated carrier.
Figure 3:
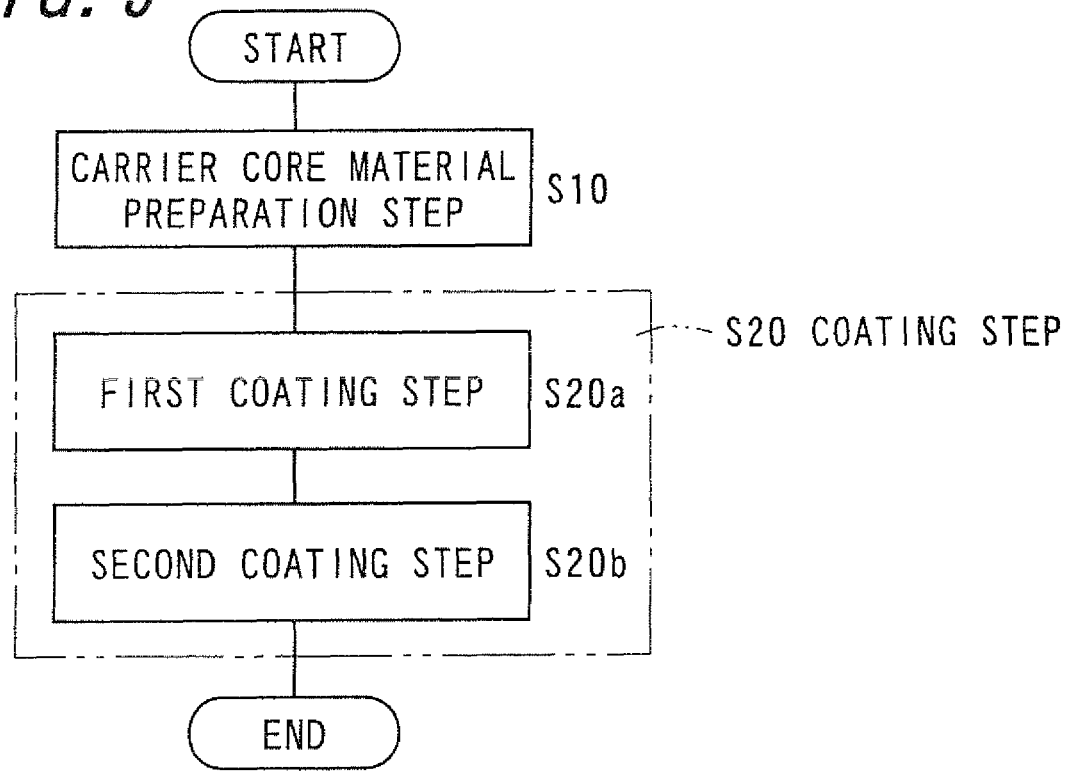
FIG. 3 is a process chart showing the production method of the resin-coated carrier.

The resin-coated carrier 2 can be prepared by the production methods shown in FIGS. 2 and 3. FIGS. 2 and 3 are process charts showing the production method of the resin-coated carrier 2. The production method of the resin-coated carrier 2 shown in FIG. 2 will be described below.

The production method of the resin-coated carrier 2 shown in FIG. 2 comprises a carrier core material preparation step S1 and a coating step S2.

(Carrier Core Material Preparation Step)

Figure 4:
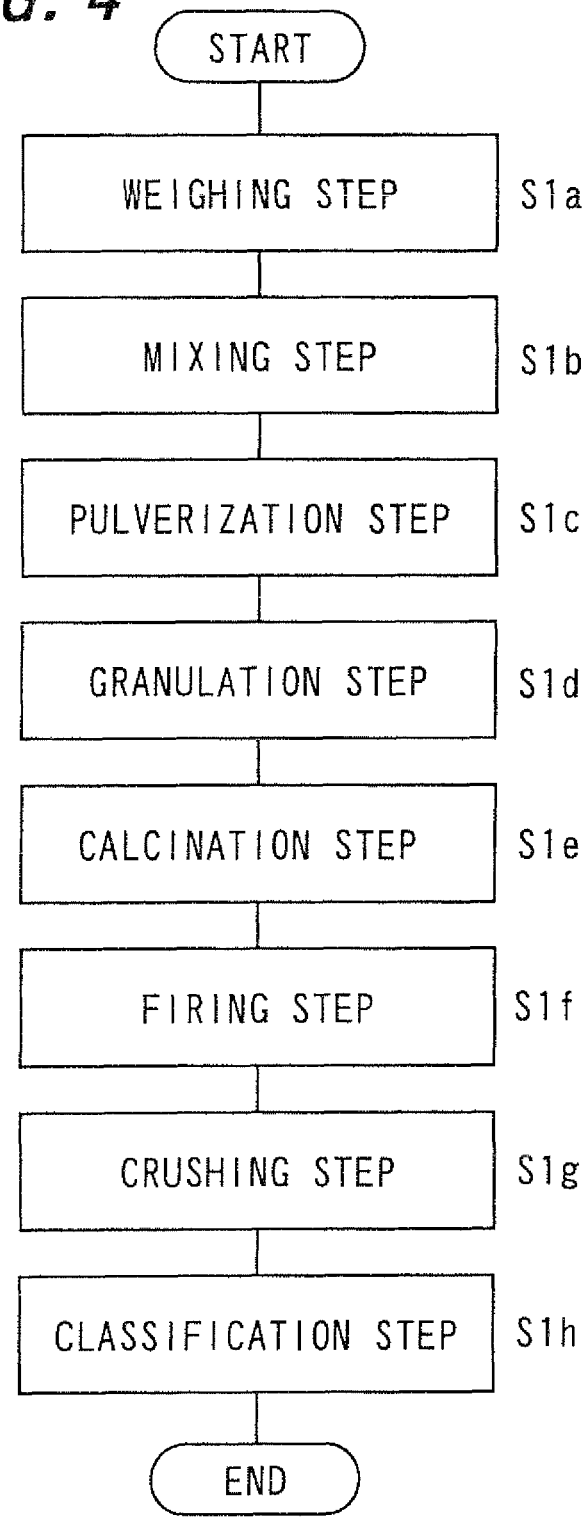
FIG. 4 is a process chart showing the production method of a carrier core material using the resin addition method.

At the carrier core material preparation step of step S1, a carrier core material 2*a* is prepared. The carrier core material 2*a* can be prepared by, for example, a resin addition method. FIG. 4 is a process chart showing the production method of the carrier core material 2*a* using the resin addition method.

A production method of the carrier core material 2*a* using the resin addition method includes a weighing step S1*a*, a mixing step S1*b*, a pulverization step S1*c*, a granulation step S1*d*, a calcination step S1*e*, a firing step S1*f*, a crushing step S1*g* and a classification step S1*h*.

[Weighing Step and Mixing Step]

At the weighing step S1*a* and the mixing step S1*b*, raw materials of a carrier core material 2*a*, such as magnetic oxide, are weighed, and mixed to obtain a metal raw mixture. In the case of using two kinds or more of magnetic oxides, those magnetic oxides are weighed such that blending ratio of two kinds or more of magnetic oxides matches the desired component of magnetic oxide.

Resin particles are added to the metal raw material mixture. The resin particles added include carbon-based resin particles such as polyethylene and acrylic resin, and resin particles containing silicone such as silicone resin (hereinafter referred to as "silicone-based resin particles"). The carbon-based resin particles and the silicone-based resin particles are the same in that those particles are burned at the calcination step S1*c* described hereinafter, and a hollow structure is formed in a calcined powder by a gas generated during burning. The carbon-based resin particles merely form a hollow structure during calcination, but the silicone-based resin particles become $SiO_2$ after burning, and remain in a hollow structure formed.

Regarding a volume average particle size and an addition amount of the resin particles, the carbon-based resin particles and the silicone-based resin particles each have the volume average particle size of preferably from 2 μm to 8 μm, and are added in an amount of preferably from 0.1 wt % to 20 wt %, and most preferably 12 wt %, based on the total weight of raw materials of the carrier core material.

[Pulverization Step]

At the pulverization step S1*c*, the metal raw material mixture and the resin particles are introduced into a pulverizer such as a vibration mill, and are pulverized to a volume average particle size of from 0.5 to 2.0 μm, and preferably 1 μm. By pulverizing the metal raw material mixture and the resin particles to this range, the diameter of pores present on the surface of the carrier core material 2*a* can be adjusted to be 0.1 μm or more and 1.0 μm or less.

Water, 0.5 to 2 wt % of a binder and 0.5 to 2 wt % of a dispersant are added to the pulverized material to form a slurry having a solid content concentration of from 50 to 90 wt %. The slurry is wet pulverized with a ball mill or the like. The binder used here is preferably polyvinyl alcohol, and the dispersant used here is preferably ammonium polycarbonate.

[Granulation Step]

At the granulation step S1*d*, the slurry wet-pulverized is introduced into a spraying drier, and sprayed in hot air of 100 to 300° C. to dry the slurry. Thus, a granulated powder having a volume average particle size of from 10 to 200 μm is obtained. Considering a volume average particle size of the resin-coated carrier produced by the present production method, the particle size of the granulated powder obtained is controlled by removing coarse particles and fine particles outside the above range of the volume average particle size by a vibration sieve. Specifically, since the volume average particle size of the resin-coated carrier is preferably 25 μm or more and 50 μm or less, it is preferred that the volume average particle size of the granulated powder is controlled to 15 to 100 μm.

[Calcination Step]

At the calcination step S1*e*, the granulated powder is introduced into a furnace heated to from 800° C. to 1000° C., and calcined in the atmosphere to obtain a calcined product. In this case, a hollow structure is formed in the granulated powder by a gas generated by burning the resin particles. In the case where the silicone-based resin particles are used as the resin particles, $SiO_2$ which is non-magnetic oxide is formed in the hollow structure.

[Firing Step]

At the firing step S1*f*, the calcined product having the hollow structure formed therein is introduced into a furnace heated to 1100 to 1250° C. and burned to form ferrite. Thus, a calcined product is obtained. Where the temperature at the time of the firing is high, oxidation of iron proceeds and magnetic force is decreased. Therefore, the remanent magnetization of the carrier core material can be adjusted by, for example, firing temperature.

Atmosphere during the firing is appropriately selected depending on the kind of metal raw materials such as magnetic oxide, of raw materials of the carrier core material. For example, in the case where the metal raw materials are Fe and Mn (molar ratio: 100:0 to 50:50), nitrogen atmosphere is required. In the case where the metal raw materials are Fe, Mn and Mg, nitrogen atmosphere and oxygen partial pressure controlled atmosphere are preferred. In the case where the metal raw materials are Fe, Mn and Mg and the molar ratio of Mg exceeds 30%, air atmosphere may be used.

[Crushing Step and Classification Step]

At the crushing step S1*g*, the fired product obtained at the firing step is coarsely crushed with hammer mill crushing or the like, and then subjected to primary classification with an air classifier. Further, at the classification step S1*h*, after making a particle size uniform with a vibration sieve or an ultrasonic wave sieve, the particles are put in a magnetic field concentrator to remove a non-magnetic component. Thus, a carrier core material 2*a* is obtained.

The carrier core material 2*a* can further be prepared by a silica particle addition method. The production method of the carrier core material 2*a* using the silica particle addition method differs from the resin addition method in that the calcination step is not included. Furthermore, at the mixing step of the silica particle addition method, silica particles are added to the metal raw material mixture, in place of carbon-based resin particles or silicone-based resin particles. The silica particles do not burn and generate a gas, differing from the resin particles described in the resin addition method, but are incorporated into a fired product forming ferrite at the firing step described hereinafter. For this reason, at the firing step of the silica particle addition method, a fired product containing silica particles is obtained, and the fired product having the silica particles incorporated therein has the structure similar to a "fired product having residual $SiO_2$ in hollow structure" described in the resin addition method.

The silica particles have a volume average particle size of preferably from 1 to 10 μm. The silica particles are added preferably in an amount of from 1 to 50 wt % based on the total weight of all raw materials of the carrier core material. In the carrier core material obtained through the subsequent steps, an expression "$0.25 \leq A \leq 0.40$" is satisfied, and the apparent density is 1.6 g/cm$^3$ or more and 2.0 g/cm$^3$ or less, where A is a ratio of an apparent density to a true density in the carrier core material 2*a*, that is, (apparent density of carrier core material 2*a*)/(true density of carrier core material 2*a*). Furthermore, it was found that the silica particles do not adversely affect electrophotographic development by a two-component developer produced using the carrier core material.

[Coating Step S2]

At the coating step of step S2, a coating layer is formed on the surface of the carrier core material 2*a* obtained at the carrier core material preparation step S1, by a dry process.

At the coating step S2, the carrier core material 2*a* and the coating resin particles are mixed and impact force is applied to the resulting mixture while stirring the mixture under heating, thereby adhering the coating resin particles to the surface of the carrier core material 2*a* and forming a film of the coating resin particles. The carrier core material is further heated to cure the coating resin particles which are formed into a film. As a result, a coating layer can be formed on the surface of the carrier core material 2*a*, and the resin-coated carrier 2 having the resin coating layer 2*b* constituted of only the coating layer is obtained.

A coating apparatus for mixing and stirring the carrier core material 2*a* and the coating resin particles includes a Henschel mixer (manufactured by Mitsui Mining Co., Ltd.), Hybridizer (manufactured by Nara Machinery Co., Ltd.) and SPARTANRYUZER (Dalton Corporation).

The temperature in the apparatus is increased by mixing and stirring the carrier core material 2*a* and the coating resin particles. The temperature in this case is preferably 60° C. or higher and 200° C. or lower. The stirring time is preferably 60 minutes or longer and 360 minutes or shorter.

Where the temperature when stirring the carrier core material 2*a* and the coating resin particles is too high or the stirring time is too long, there is the possibility that a resin constituting the coating resin particles adhered to the surface of the carrier core material 2*a* is too soft and enters the inside of pores of the carrier core material 2*a*, and the resin coating layer 2*b* formed on pores sags. Furthermore, where the temperature when stirring the carrier core material 2*a* and the coating resin particles is too low or the stirring time is too short, there is the possibility that the coating resin particles are not sufficiently formed into a film. The uniform resin coating layer 2*b* can be formed on the surface of the carrier core material 2*a* by stirring the carrier core material 2*a* and the coating resin particles under the conditions described above.

Coating resin particles are preferably resins that thermally deform by heat and mechanical impact force and adheres and examples thereof include styrene resin, acryl resin, styrene-acrylic copolymer resin, vinyl resin, ethylene resin, polyamide resin and polyester resin and the like.

The coating resin particles are preferably mixed with the carrier core material 2*a* in an amount of 20% by weight or less, and preferably 10% by weight or less, based on the weight of the carrier core material 2*a*.

The volume average particle size of the coating resin particles is less than 1 μm, and preferably 0.05 μm or more and less than 1 μm. This volume average particle size permits to give sufficient impact force to the coating resin particles in adhering the coating resin particles to the surface of the carrier core material 2*a*, and to form the uniform resin coating layer 2*b* free of exposure of the carrier core material 2*a*. Where the volume average particle size of the coating resin particles is 1 μm or more, impact force does not sufficiently transmit to the coating resin particles in adhering the coating resin particles to the surface of the carrier core material 2*a*, and the possibility of film formation is decreased.

An apparatus for curing the coating resin particles which are formed into a film includes a hot air circulation type heating apparatus and a rotary kiln furnace. The temperature for curing is preferably 80° C. or higher and 200° C. or lower, and the time required for curing is preferably 20 minutes or longer and 10 hours or shorter.

In the resin-coated carrier 2 having the resin coating layer 2*b* formed thereon by the dry process, a resin is not contained in pores of the carrier core material 2*a*. The diameter of pores on the surface of the carrier core material 2*a* is about 0.7 μm. Therefore, if the resin coating layer 2*b* is formed by a wet process using an organic solvent, a resin may permeate into the pores by a capillary phenomenon. However, because the resin coating layer 2*b* is formed by a dry process, the resin constituting the coating resin particles can be suppressed from entering the pores of the carrier core material 2*a* at the coating step S2, and the resin-coated carrier 2 which does not contain a resin in the pores of the carrier core material 2*a* can be obtained.

The coating resin particles increase cohesive force with decreasing a particle size thereof. As a result, the coating resin particles cannot be present as primary particles, and are present as aggregate such as secondary particles. For this reason, even in the case where the coating resin particles having a primary particle size smaller than a diameter of pores on the surface of the carrier core material 2*a* are used, an apparent particle size of the coating resin particles is increased by aggregation, and this permits to suppress the resin constituting the coating resin particles from entering the pores of the carrier core material 2*a* in the coating step S2.

The production method of the resin-coated carrier 2 shown in FIG. 3 will be described below.

The production method of the resin-coated carrier 2 shown in FIG. 3 comprises a carrier core material preparation step S10 and a coating step S20. The coating step S20 comprises a first coating step S20*a* and a second coating step S20*b*. At the carrier core material preparation step S10, the carrier core material 2*a* is prepared in the same manner as at the carrier core material preparation step S1 shown in FIG. 2.

[First Coating Step]

At the first coating step of Step S20*a*, a first resin particle-adhered carrier core material is obtained by mixing the carrier core material 2*a* obtained at the carrier core material preparation step S10 and the first resin particles and applying impact force to the resulting mixture while stirring the mixture under heating, thereby adhering the first resin particles to the surface of the carrier core material.

The first resin particles and the second resin particles used at the second coating step described hereinafter are the same resin particles as the coating resin particles used at the coating step S2 shown in FIG. 2. However, the first resin particles are resin particles having a volume average particle size larger than that of the second resin particles.

The volume average particle size of the first resin particles is preferably 0.05 μm or more and 1.0 μm or less. Where the volume average particle size of the first resin particles exceeds 1.0 μm, the first resin particles cannot stably be adhered to the surface of the carrier core material 2*a* so as to clog pores having relatively large diameter on the surface of the carrier core material 2*a* having a plurality of pores having different diameter formed thereon. Where the volume average particle size of the first resin particles is less than 0.05 μm, the first resin particles enter the pores having relatively large diameter. Since the volume average particle size of the first resin particles falls within the above range, the first resin particles can be adhered to the surface of the carrier core material 2*a* so as to clog the pores having relatively large diameter.

The temperature in stirring the carrier core material 2*a* and the first resin particles is preferably 60° C. or higher and 200° C. or lower. The stirring time is preferably 60 minutes or longer and 360 minutes or shorter.

The above-described coating apparatus can be used as a coating apparatus for mixing and stirring the carrier core material 2*a* and the first resin particles.

[Second Coating Step]

At the second coating step of Step S20*b*, the first resin particle-adhered carrier core material and the second resin particles are mixed and impact force is applied to the resulting mixture while stirring the mixture under heating. As a result, the second resin particles are adhered to the surface of the first resin particle-adhered carrier core material, and the first resin particles and the second resin particles are formed into a film on the surface of the carrier core material 2*a*. The first resin particles and second resin particles which are formed into a film are cured by heating the carrier core material. Thereby it is possible to form a coating layer on the surface of the carrier core material 2*a*. Thus, the resin-coated carrier 2 having formed thereon the resin coating layer 2*b* constituted of only the coating layer is obtained.

The volume average particle size of the second resin particles is preferably 0.05 μm or more and 1.0 μm or less. Where the volume average particle size of the second resin particles exceeds 1.0 μm, the second resin particles cannot stably be adhered to the surface of the carrier core material 2*a* so as to clog pores having relatively small diameter on the surface of the carrier core material 2*a* having a plurality of pores having different diameter formed thereon. Where the volume average particle size of the second resin particles is less than 0.05 μm, the second resin particles enter the pores having relatively small diameter. Since the volume average particle size of the second resin particles falls within the above range, the second resin particles can be adhered to the surface of the carrier core material 2*a* so as to clog the pores having relatively small diameter on the carrier core material 2*a* having a plurality of pores having different diameter formed thereon.

Ratio between the volume average particle size of the first resin particles and the volume average particle size of the second resin particles (volume average particle size of first resin particles/volume average particle size of second resin particles) is preferably more than 1.0 and 2.0 or less.

The temperature in stirring the first resin particle-adhered carrier core material and the second resin particles is preferably 60° C. or higher and 200° C. or lower. The stirring time is 60 minutes or longer and 360 minutes or shorter.

The above-described coating apparatus can be used as a coating apparatus for mixing and stirring the first resin particle-adhered carrier core material and the second resin particles.

An apparatus for curing the first resin particles and second resin particles which are formed into a film includes a hot air circulation type heating apparatus and a rotary kiln furnace. The temperature for curing is preferably 80° C. or higher and 200° C. or lower, and the time required for curing is preferably 20 minutes or longer and 10 hours or shorter.

Thus, the resin-coated carrier 2 may be produced by the production method comprising the first coating step S20*a* and the second coating step S20*b*.

A plurality of pares having different diameter are formed on the surface of the carrier core material 2*a*. For this reason, in the case of forming the resin coating layer by adhering the coating resin particles an the surface of the carrier core material 2*a* by one action as shown in FIG. 2, it is difficult to optimize a particle size of the coating resin particles. By mixing the carrier core material 2*a* and the first resin particles and applying impact force to the resulting mixture while stirring the mixture under heating at the first coating step S20*a*, the first resin particles can be adhered to the surface of carrier core material 2*a* so as to clog the pores having relatively large diameter present on the carrier core material 2*a*. By mixing the first resin particle-adhered core material and the second resin particles and applying impact force to the resulting mixture while stirring the mixture under heating in the second coating step S20*b*, the second resin particles can be adhered to the surface of carrier core material 2*a* so as to clog the pores having relatively small diameter present on the carrier core material 2*a*. As a result, the resin particles do not enter the inside of the pores of the carrier core material 2*a*, and the uniform resin coating layer 2*b* can stably be formed.

<Second Embodiment>

Figure 5:
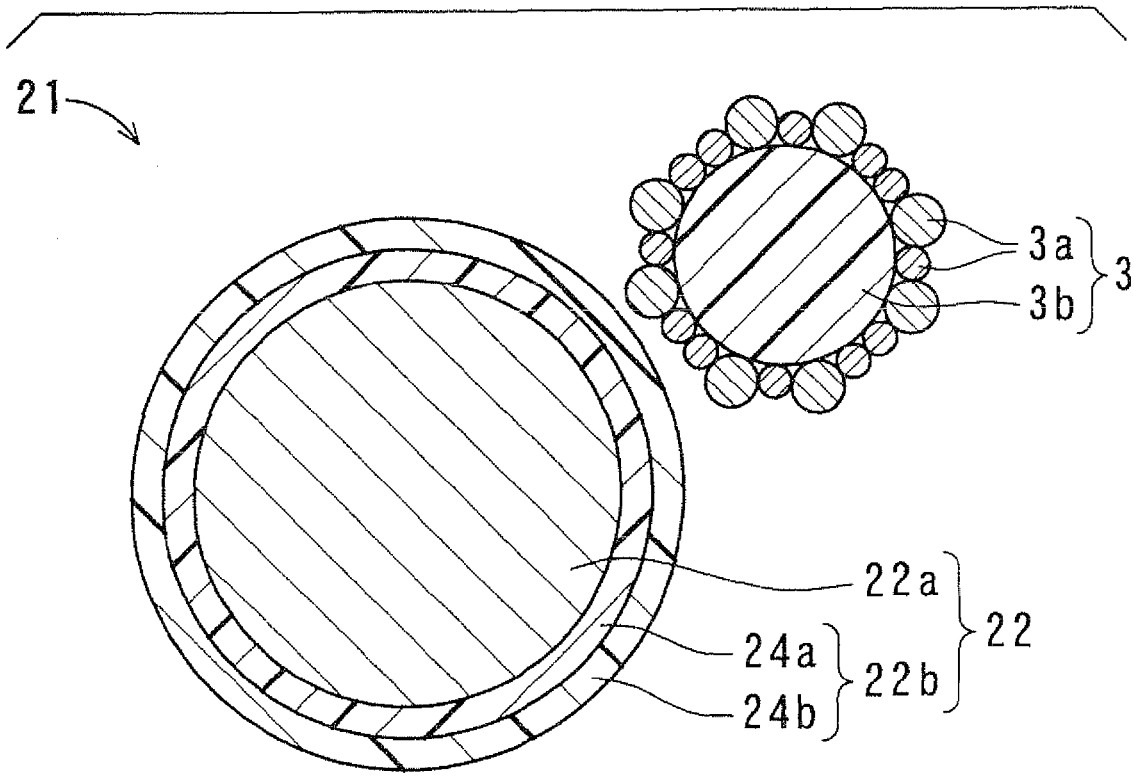
FIG. 5 is a sectional view schematically showing the constitution of a two-component developer of the invention.

The resin-coated carrier according to the second embodiment of the invention comprises a carrier core material, a coating layer formed on the surface of the carrier core material, and an outermost shell layer formed on the coating layer. FIG. 5 is a sectional view schematically showing the constitution of a two-component developer 21 of the invention. The two-component developer 21 comprises a resin-coated carrier 22 of the invention and a toner 3. The resin-coated carrier 22 comprises a carrier core material 22*a* and a resin coating layer 22*b* formed on the surface of the carrier core material 22*a*. In this embodiment, the resin coating layer 22*b* comprises a coating layer 24*a* and an outermost shell layer 24*b*. The constitution of the toner 3 will be described hereinafter.

The resin-coated carrier 22 has the same constitution as the resin-coated carrier 2 according to the first embodiment, except that the outermost shell layer 24*b* is formed on the coating layer 24*a*.

Figure 6:
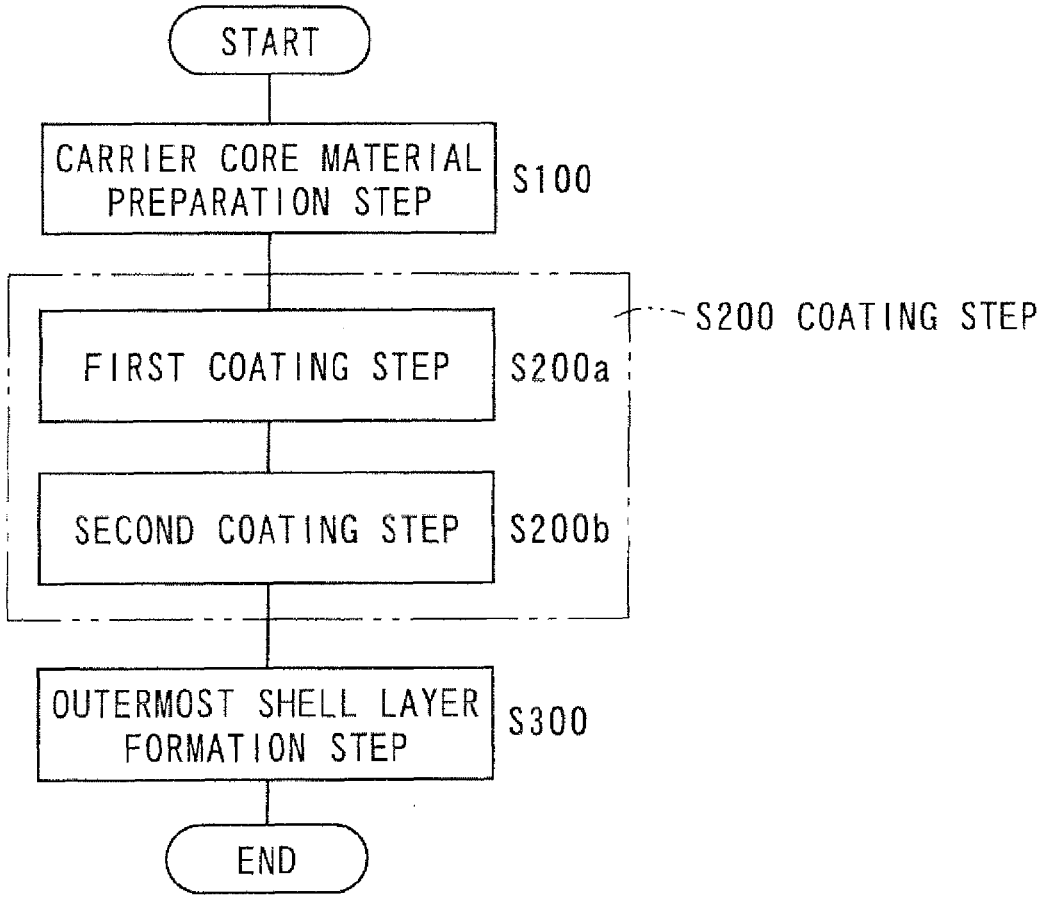
FIG. 6 is a process chart showing the production method of a resin-coated carrier.

The resin-coated carrier 22 can be prepared by the production method shown in FIG. 6. FIG. 6 is a process chart showing the production method of the resin-coated carrier 22. The production method of the resin-coated carrier 22 comprises a carrier core material preparation step S100, a coating step S200 and an outermost shell layer formation step S300. The coating step S200 comprises a first coating step S200*a* and a second coating step S200*b*. The carrier core material preparation step S100 and the coating step S200 are the same as the carrier core material preparation step S10 and the coating step S20 shown in FIG. 3, respectively.

[Outermost Shell Layer Formation Step]

At the outermost shell layer formation step of Step S300, the carrier core material 22*a* having the coating layer 24*a* formed thereon, obtained in the coating step S200, and third resin particles having a glass transition temperature higher than those of the first resin particles and the second resin particles used in the coating step S200 are mixed, and impact force is applied to the resulting mixture while stirring the mixture under heating, thereby the third resin particles are adhered to the surface of the carrier core material 22*a* having the coating layer 24*a* formed thereon, and formed into a film. The third resin particles which are formed into a film are cured by heating the carrier core material. Thus, the outermost shell layer 24*b* is formed on the coating layer 24*a*. By this, the resin-coated carrier 22 having the resin coating layer 22*b* constituted of the coating layer 24*a* and the outermost shell layer 24*b* is obtained.

The temperature in stirring the carrier core material 22*a* having the coating layer 24*a* formed thereon and the third resin particles is preferably 60° C. or higher and 200° C. or lower, and the stirring time is preferably 60 minutes or longer and 360 minutes or shorter.

The above-described coating apparatus can be used as a coating apparatus which mixes and stirs the carrier core material 22*a* having the coating layer 24*a* formed thereon and the third resin particles.

An apparatus for curing the third resin particles which are formed into a film includes a hot air circulation type heating apparatus and a rotary kiln furnace. The temperature for curing is preferably 80° C. or higher and 200° C. or lower, and the time required for curing is preferably 20 minutes or longer and 10 hours or shorter.

As the third resin particles, a resin having the same kind of the first resin particle and second resin particle may be used, but a resin whose monomer composition ratio and kind of monomer are different from those of the first and second resin particles may be used so as to have a glass transition temperature higher than those of the first resin particles and the second resin particles.

The glass transition temperature of the third resin particles is preferably 60° C. or higher and 200° C. or lower. The glass transition temperature of the first resin particles and the second resin particles is 60° C. or higher and 200° C. or lower.

The volume average particle size of the third resin particles is preferably 0.05 μm or more and less than 1.0 μm.

The thickness of the outermost shell layer 24*b* is preferably 0.05 μm or more and 1.0 μm.

Thus, by using the third resin particles having a glass transition temperature higher than that of the first resin particles and the second resin particles used in the coating step S200 in forming the outermost shell layer 24*b*, the strong outermost shell layer 24*b* having excellent heat resistance can be formed on the coating layer 24*a*. As a result, the strong resin-coated carrier 22 having excellent heat resistance can be obtained. Further, formation of the resin coating layer 22*b* made of the third resin particles having a glass transition temperature higher than those of the first resin particles and the second resin particles on the coating layer 24*a* constituted by the first resin particles and the second resin particles, can ensure charge providing characteristics to the toner 3.

The outermost shell layer 24*b* may be formed on the coating layer of the resin-coated carrier 22 prepared by the production method shown in FIG. 2.

2. Two-Component Developer

A two component developer 1 according to one embodiment of the invention comprises the carrier core material 2 of the first embodiment, and a toner 3 comprising a binder resin and a colorant. Further, the two-component developer 21 according to another embodiment of the invention comprises the resin-coated carrier 22 of the second embodiment, and the toner 3 comprising a binder resin and a colorant. The resin-coated carriers 2 and 22 of the invention can give stable charge amount to the toner 3. Therefore, it is possible to obtain the two component developer 1 having stable charge amount even though the number of printing is increased. When such a two-component developer 1 and 21 are used, it is possible to form a high quality image that can finely reproduce an image, has good color reproducibility and high image density and is free of image defects such as fog, over a long period of time.

The two-component developer of the invention will be described below by reference to the two-component developer 1 containing the resin-coated carrier 2.

The toner 3 contains a toner base particle 3*b*. The toner base particle 3*b* comprises a binder resin and a colorant as essential components, and further contains a charge control agent and a release agent. Furthermore, the toner 3 contains two kinds or more of external additives 3*a* having different particle size as shown in FIG. 1.

[Binder Resin]

The binder resin is not particularly restricted, and a known binder resin for black toner or color toner is usable. Examples thereof include a polyester resin, a styrene resin such as polystyrene and a styrene-acrylic acid ester copolymer resin, an acrylic resin such as polymethylmethacrylate, a polyolefin resin such as polyethylene, polyurethane, and an epoxy resin. In addition, a resin obtained by polymerization reaction by mixture of a monomer mixture material and a release agent may be used. The binder resins may be used each alone, or two or more of them may be used in combination.

In a case of using the polyester resin as the binder resin, examples of the aromatic alcohol ingredient required for obtaining the polyester resin include bisphenol A, polyoxyethylene-(2.2)-2,2-bis(4-hydroxyphenyl)propane, polyoxyethylene-(2.0)-2,2-bis(4-hydroxyphenyl)propane polyoxypropylene-(2.0)-2,2-bis(4-hydroxyphenyl)propane, polyoxypropylene-(2.2)-polyoxyethylene-(2.0),-2,2-bis(4-hydroxyphenyl)propane, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane, and derivatives thereof.

Further, examples of the polybasic acid ingredient in the polyester resin include dibasic acids such as succinic acid, adipic acid, sebasic acid, azelaic acid, dodecenyl succinic acid, n-dodecyl succinic acid, malonic acid, maleic acid, fumaric acid, citraconic acid, itaconic acid, glutaconic acid, cyclohexane dicarboxylic acid, ortho-phthalic acid, isophthalic acid, and terephthalic acid, tri- or higher basic acids such as trimellitic acid, trimethinic acid, and pyromellitic acid, as well as anhydrides and lower alkyl esters thereof. With a view point of heat resistant cohesion, terephthalic acid or lower alkyl esters thereof are preferred.

Here, the acid value of the polyester resin constituting the toner is preferably from 5 to 30 mgKOH/g. In a case where the acid value is less than 5 mgKOH/g, the charging characteristic of the resin is lowered, and the organic bentonite as the charge controller is less dispersible in the polyester resin. They give undesired effects on the rising of the charged amount and the stability of the charged amount by repetitive development in continuous use. Accordingly, the above-mentioned range is preferable.

[Colorant]

As a colorant, various kinds of colorants are usable in accordance with a desired color; for example, a yellow toner colorant, a magenta toner colorant, a cyan toner colorant, a black toner colorant and the like.

As a yellow toner colorant, examples thereof include, in reference to the color index classification, an azo dye such as C. I. Pigment Yellow 1, C. I. Pigment Yellow 5, C. I. Pigment Yellow 12, C. I. Pigment Yellow 15 and C. I. Pigment Yellow 17, an inorganic pigment such as a yellow iron oxide or an ocher, a nitro dye such as C. I. Acid Yellow 1, an oil soluble dye such as C. I. Solvent Yellow 2, C. I. Solvent Yellow 6, C. I. Solvent Yellow 14, C. I. Solvent Yellow 15, C. I. Solvent Yellow 19 or C. I. Solvent Yellow 21.

As a magenta toner colorant, examples thereof include, in reference to the color index classification, C. I. Pigment Red 49, C. I. Pigment Red 57, C. I. Pigment Red 81, C. I. Pigment Red 122, C. I. Solvent Red 19, C. I. Solvent Red 49, C. I. Solvent Red 52, C. T. Basic Red 10 and C. I. Disperse Red 15.

As a cyan toner colorant, examples thereof include, in reference to the color index classification, C. T. Pigment Blue 15, C. I. Pigment Blue 16, C. I. Solvent Blue 55, C. I. Solvent Blue 70, C. I. Direct Blue 25 and C. I. Direct Blue 86.

As a black toner colorant, examples thereof include carbon blacks such as channel black, roller black, disk black, gas furnace black, oil furnace black, thermal black, and acetylene black. The carbon black may be selected properly from among various kinds of carbon blacks mentioned above according to a target design characteristic of toner.

In addition to these pigments, a bright red pigment, a green pigment and the like are also usable as a colorant. The colorants may be used each alone, or two or more of them may be used in combination. Further, two or more of the similar color series are usable, or one of or two or more of the different color series are also usable.

The colorant may be used in the form of a masterbatch. The masterbatch of the colorant can be produced in the same manner as a general masterbatch. For example, a melted synthetic resin and a colorant are kneaded so that the colorant is uniformly dispersed in the synthetic resin, then the resultant mixture thus melt-kneaded is granulated to produce a masterbatch. For the synthetic resin, the same kind as the binder resin of the toner, or a synthetic resin having excellent compatibility with the binder resin of the toner is used. At this time, a ratio of the synthetic resin and the colorant to be used is not particularly restricted, but preferably 30 to 100 parts by weight based on 100 parts by weight of the synthetic resin. Further, the masterbatch is granulated so as to have a particle size of about 2 to 3 mm.

Further, the amount of a colorant to be used is not particularly restricted, but preferably 5 to 20 parts by weight based on 100 parts by weight of the binder resin. This amount does not refer to the amount of the masterbatch, but to the amount of the colorant itself included in the masterbatch. By using a colorant within such a range, it is possible to form a high-density and extremely high-quality image without damaging various physical properties of the toner.

[Charge Control Agent]

The charge control agent is added for the purpose of controlling frictional electrification characteristic of the toner 3. The charge control agent is selected from a charge control agent for controlling positive charges and a charge control agent for controlling negative charges, which are commonly used in this field. Examples of the charge control agent for controlling positive charges include a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt.

Examples of the charge control agent for controlling negative charges include oil soluble dyes such as oil black and spiron black, a metal-containing azo compound, an azo complex dye, metal salt naphthenate, metal complex and metal salt of a salicylic acid and a derivative thereof, a boron compound, a fatty acid soap, long-chain alkylcarboxylic acid salt, and a resin acid soap. Chrome, zinc, and zirconium can be cited as the metal in the metal-containing azo compound, the azo complex dye, the metal salt naphthenate, the metal complex and metal salt of the salicylic acid and a derivative thereof. Among the above-stated charge control agent for controlling negative charges, the boron compound is particularly preferable because it contains no heavy metal.

The charge control agent for controlling positive charges and the charge control agent for controlling negative charges can be used according to their intended applications. The charge control agents may be used each alone, or two or more of them may be used in combination as necessary. A usage of the charge control agent is not limited to a particular level and may be selected as appropriate from a wide range. A preferable usage of the charge control agent is 0.5 to 3 parts by weight based on 100 parts by weight of the binder resin.

[Release Agent]

The release agent can use the one commonly used in this field, and examples thereof include a petroleum wax such as a paraffin wax and a derivative thereof; a microcrystalline wax and a derivative thereof; a hydrocarbon synthetic wax such as a Fischer-Tropsch wax and a derivative thereof; a polyolefin wax and a derivative thereof; a low-molecular-weight polypropylene wax and a derivative thereof; a polyolefin polymer wax (a low-molecular-weight polyethylene wax and the like) and a derivative thereof; a botanical wax such as a carnauba wax and a derivative thereof; a rice wax and a derivative thereof; a candelilia wax and a derivative thereof; a plant wax such as a Japan wax; an animal wax such as a beeswax and a spermaceti wax; a synthetic wax of fat and oil such as a fatty acid amide and a phenol fatty acid ester; a long-chain carboxylic acid and a derivative thereof; a long-chain alcohol and a derivative thereof; a silicone polymer; and a higher fatty acid. Note that examples of the derivatives include an oxide, a vinyl monomer-wax block copolymer and a vinyl monomer-wax graft modified material. The amount of the release agent to be used is not particularly restricted and is appropriately selectable from a wide range, but preferably 0.2 to 20 parts by weight based on 100 parts by weight of the binder resin.

[External Additive]

The external additive 3*a* of the toner 3 can use the one commonly used in the field, and examples thereof include a silicon oxide, a titanic oxide, a silicon carbide, an aluminum oxide and a barium titanate. According to the embodiment, as the external additive, two or more of external additives having different particle sizes are used in combination, and at least one of the external additives has a volume average particle size of a primary particle size of 0.1 μm or more and 0.2 μm or less. By using the external additive in which at least one of the external additives has a primary particle size of 0.1 μm or more, it is possible to improve transfer property particularly with respect to color toner and to charge the toner 3 for long term and in a stable manner, without causing decrease in chargeability due to adhesion of the external additive to the surface of the carrier. The amount of the external additive to be used is not particularly restricted, but preferably 0.1 to 3.0 parts by weight based on 100 parts by weight of the toner 3.

The materials for the toner 3, except for the external additive, are mixed by a mixer such as HENSCHEL MIXER, SUPERMIXER, MECHANOMILL or a Q-type mixer, and the material mixture thus acquired is melt-kneaded by a kneader such as a biaxial kneader, a uniaxial kneader or a continuous double-roller kneader, at a temperature of about 70 to 180° C., and thereafter cooled and solidified. After the material mixture of the toner 3 that has been melt-kneaded is cooled and solidified, the material mixture is coarsely pulverized by a cutter mill, a feather mill or the like. The material mixture thus pulverized coarsely is subjected to fine pulverization. For the fine pulverization, a jet mill, a fluidized-bed type jet mill or the like is used. Such mills perform pulverization of toner particles by causing air currents including the toner particles to collide with one another in a plurality of directions, thereby causing the toner particles to collide with one another. Whereby, it is possible to produce the nonmagnetic toner base particle 3*b* that has a specific particle size distribution. The particle size of the toner base particle 3*b* is not particularly restricted, but the volume average particle size thereof is preferably in a range of 3 to 10 μm. Furthermore, the particle size may be adjusted by classification and the like as necessary. To the toner base particle 3*b* thus produced, the above-mentioned external additive 3*a* is added by a known method. Note that, the method for producing the toner 3 is not restricted to the above.

The two-component developer 1 can be manufactured by mixing the toner 3 and the above-mentioned resin-coated carrier 2. A mixing ratio of the toner 3 and the resin-coated carrier 2 is not particularly limited and in consideration of the use thereof in a high-speed image forming apparatus (which forms A4-sized images on 40 sheets or more per minute), it is preferred that a ratio of a total projected area of the toner 3 (a sum of projected areas of all the toner particles) to a total surface area of the resin-coated carrier 2 (a sum of surface areas of all the resin-coated carrier particles), that is, ((the total projected area of the toner 3/the total surface area of the resin-coated carrier 2)×100), is 30% to 70% in a state where a ratio represented by an average particle size of the resin-coated carrier 2/an average particle size of the toner 3 is 5 or more. This allows the charging property of the toner 3 to be stably maintained in a sufficiently favorable state, resulting in a favorable two-component developer 1 which can stably form high-quality images for a long period of time even in a high-speed image forming apparatus.

For example, assuming that: the volume average particle size of the toner 3 is set at 6.5 μm; the volume average particle size of the resin-coated carrier 2 is set at 50 μm; and the ratio of the total projected area of the toner 3 to the total surface area of the resin-coated carrier 2 is set in a range of 30% to 70%, the two-component developer 1 will contain around 2.2 parts by weight to 5.3 parts by weight of the toner based on 100 parts by weight of the resin-coated carrier. The high-speed development using the two-component developer 1 as just described leads to the largest amount of toner consumption and the largest amount of toner supply that is supplied to a developing tank of a developing device according to the consumption of toner and toner 3. The balance of supply and demand will be nevertheless lost. And when the amount of the toner 3 contained in the two-component developer 1 exceeds a value around 2.2 to 5.3 parts by weight, the amount of charges tends to be smaller, thus failing to obtain the desired developing property, and moreover the amount of toner consumption is larger than the amount of toner supply, thus failing to impart sufficient charges to the toner 3, which causes the deterioration of image quality. Furthermore, when the amount of the resin-coated carrier 2 contained in the developer is small, the amount of charges tends to be larger and thus, the toner 3 is less easily separated from the resin-coated carrier 2 through the electric field, thereby causing the deterioration of image quality.

In the embodiment, the total projected area of the toner 3 was determined as follows. Assuming that specific gravity of the toner 3 was 1.0, the total projected area of the toner was determined based on the volume average particle size obtained by a Coulter counter: COULTER COUNTER MULTISIZER II (trade name, manufactured by Beckman Coulter, Inc.) That is, the number of the toners relative to the weight of the toners to be mixed was counted, and the number of the toners was multiplied by the area of the toners (which was obtained based on the assumption that the area is a circle) to thus obtain a total projected area of the toner. In a similar fashion, a total surface area of the resin-coated carrier 2 was determined from the weight of the resin-coated carriers to be mixed based on the particle size which had been obtained by Microtrac: Microtrac MT3000 (trade name, manufactured by NIKKISO CO., LTD.) In this case, specific gravity of the resin-coated carrier 2 was defined as 3.7. Using the values obtained as above, the mixing ratio of the toner and the carrier was determined by (the total projected area of the toner 3/the total surface area of the resin-coated carrier 2)×100.

3. Developing Device

Figure 7:
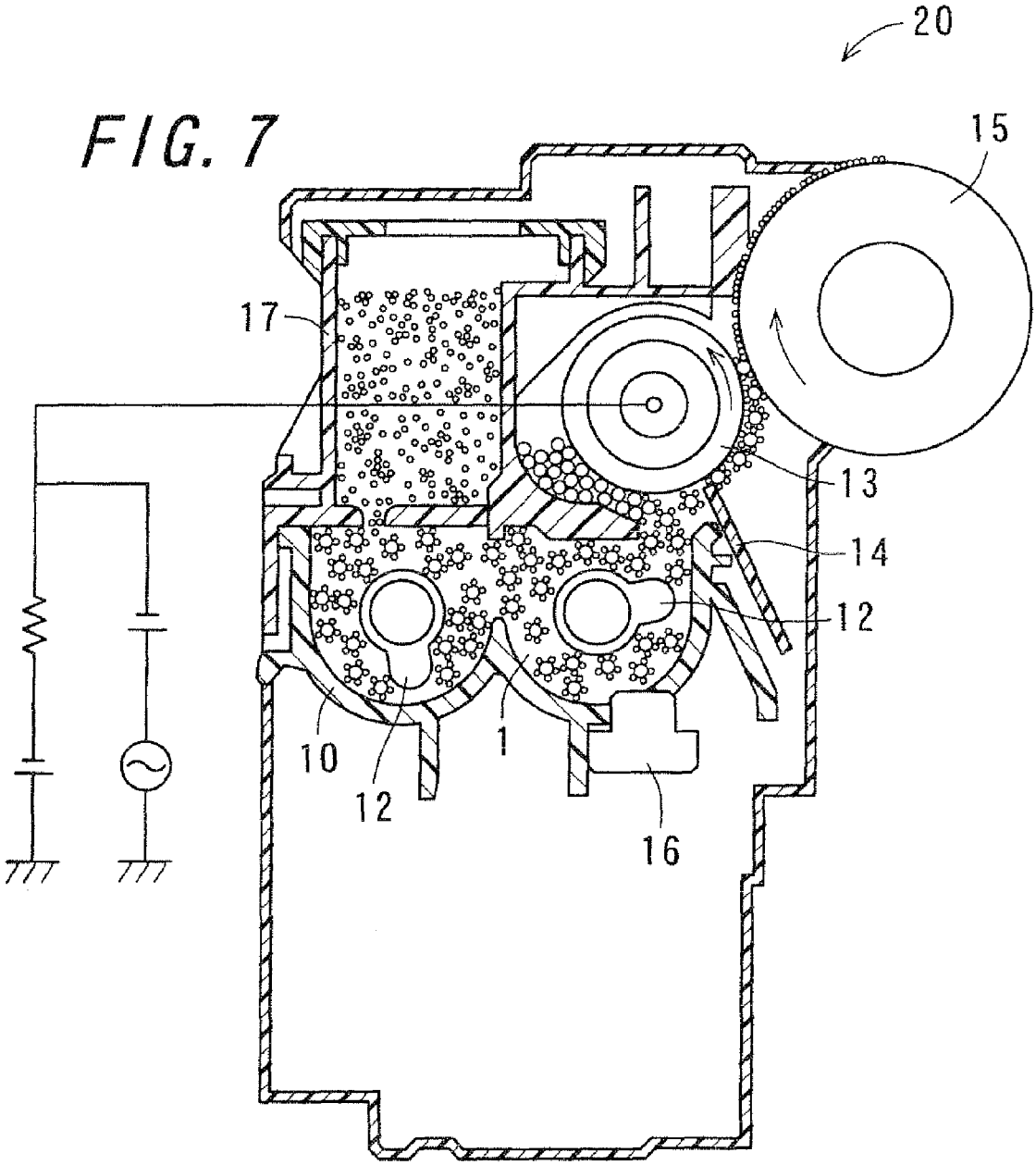
FIG. 7 is a schematic sectional view schematically showing the structure of a developing device of the embodiment.

A developing device 20 according to an embodiment of the invention performs development by using the two-component developer 1, 21 of the invention. FIG. 7 is a schematic sectional view schematically showing the structure of the developing device 20 of the embodiment. In FIG. 7, the two-component developer 1 is used. As shown in FIG. 7, the developing device 20 includes a development unit 10 for storing the two-component developer 1 and a developer bearing member (developer conveying and bearing member) 13 for conveying the two-component developer 1 to an image bearing member (image forming body, photoreceptor) 15.

The two-component developer 1 of the invention comprising the resin-coated carrier 2 of the invention and the toner 3, previously introduced into the development unit 10 is stirred by a stirring screw 12, and thereby the two-component developer is charged. The two-component developer 1 is conveyed to the developer bearing member 13 having a magnetic field-generating part (not shown) provided therein, and held on the surface of the developer bearing member 13. The two-component developer 1 held on the surface of the developer bearing member 13 is adjusted to a constant layer thickness by a developer regulating member 14, and conveyed to a development region formed in an adjacent region between the developer bearing member 13 and the image bearing member 15. By applying alternate current bias to the two-component developer conveyed up to the development region, electrostatic charge image on the image bearing member 15 is developed by a reversal development method, and a visible image is formed on the image bearing member 15.

The toner consumption resulting from formation of a visible image is detected by a toner density sensor 16 as variations in a toner density that is a weight ratio of the toner to the two-component developer, and the amount consumed is replenished from a toner hopper 17 until the toner density sensor 16 detects that the toner density has reached a predetermined specified level, thereby the toner density of the two-component developer 1 in the development unit 10 is maintained substantially at a constant level. Further, in the embodiment, a gap between the developer bearing member 13 and the developer regulating member 14, and a gap between the developer bearing member 13 and the image bearing member 15 the developing area are set, for example, to 0.4 mm. However, this is merely an example, and is therefore not restricted to this value. In this way, the developing device 20 of the invention performs development using the two-component developer 1 of the invention. As a result, the development can be performed with a toner having stabilized charge amount even though the number of printing is increased, and a toner image having high definition and free of fog can stably be formed over a long period of time.

4. Image Forming Apparatus

An image forming apparatus according to the embodiment of the invention includes the above-mentioned developing device 20. As other structures, other structures similar to those of a known electrophotographic image forming apparatus are applicable, for example, including an image bearing member, a discharging section, an exposure section, a transfer section, a fixing section, an image bearing member cleaning section, and an intermediate transfer member cleaning section. The image bearing member has a photosensitive layer on the surface of which an electrostatic image can be formed. The charging section charges the surface of the image bearing member to a predetermined potential. The exposure section irradiates the image bearing member whose surface is in a charged state with signal light corresponding to image information to form an electrostatic image (electrostatic latent image) on the surface of the image bearing member by. The transfer section transfers a toner image on the surface of the image bearing member, which has been developed by the toner 3 supplied from the developing device 20, onto an intermediate transfer member, then to a recording medium. The fixing section fixes the toner image on the surface of the recoding medium. The image bearing member cleaning section removes toner, paper dust and the like that remain on the surface of the image bearing member after the toner image is transferred to the recording medium. The intermediate transfer member cleaning section removes redundant toner adhering to the intermediate transfer member. In this way, the image forming apparatus of the invention comprises the developing device 20, and the transfer section including the intermediate transfer member on which a plurality of toner images having different colors are to be formed. The developing device 20 of the invention can stably form a toner image with high definition and free of fog over a long period of time. Therefore, even in the image forming apparatus of the invention including an intermediate transfer member and a mechanism of transferring a toner image twice, a high quality image that finely reproduces an image, has good color reproducibility and high image density and is free of image defects such as fog can stably be formed over a long period of time.

5. Method for Forming an Image

A method for forming an image according to one embodiment of the invention is performed by using the image forming apparatus of the invention that has the developing device 20 of the invention.

When an electrostatic image is developed, a development step of allowing the electrostatic image on the image bearing member 15 to be visible by reversal development, is executed for each toner color, and a plurality of toner images having different colors are overlaid on the intermediate transfer member to form a multicolor toner image. The two-component developer of the invention is that the charge amount of a toner is stabilized even though the number of printing is increased. Therefore, a multicolor image having excellent image reproducibility including color reproducibility and having high definition and high image density can stably be formed over a long period of time.

Although an intermediate transfer method using an intermediate transfer member is adopted in the embodiment, the structure to transfer a toner image directly onto the recording medium from the image bearing member may be employed. When the two-component developer of the invention is used, a charge amount of a toner is stabilized even though the number of printing is increased. As a result, even in the method of the invention in which a toner image is transferred twice using the intermediate transfer method, a high quality image that finely reproduces an image, has good color reproducibility and high image density, and is free of image defects such as fog can stably be formed over a long period of time.

EXAMPLES

Specific descriptions will be given hereinbelow concerning Examples and Comparative examples. The invention is, however, not restricted to the present examples as long as included in a gist of the invention. Hereinafter, "part" refers to "parts by weight". Further, unless otherwise mentioned, "%" refers to "% by weight".

An apparent density of a carrier core material, a remanent magnetization of a carrier core material, a true density of non-magnetic oxide, a volume average particle size of a carrier, a volume average particle size of a toner, a surface area of a carrier and a projected area of a toner, used in Examples and Comparative Examples were measured as follow.

[Apparent Density of Carrier Core Material]

An apparent density of a carrier core material was measured according to JIS 22504 (2000).

[Remanent Magnetization of Carrier Core Material]

Vibrating sample magnetometer (trade name: VSM, manufactured by Toei Industry Co., Ltd.) was used for the measurement of remanent magnetization of a carrier core material. The remanent magnetization was measured by filling a plastic container (circular) having a diameter of 6 mm with the carrier core material without space therein and changing external magnetic field.

[True Density of Non-Magnetic Oxide]

True density of non-magnetic oxide was measured by a gas phase substitution method using PYCNOMETER 1000 (trade name, manufactured by QUANTACHROME INSTRUMENTS.)

[Volume Average Particle Size of Resin-Coated Carrier]

Approximately 10 to 15 mg of a measurement sample was added to a 10 mL solution having 5% EMULGEN 109P (polyoxyethylene lauryl ether HLB 13.6, manufactured by Kao Corporation), the mixture was dispersed by an ultrasonic dispersing device for one minute, and approximately 1 mL of the mixture was added to a predetermined point of Microtrac MT-3000 (manufactured by NIKKISO CO., LTD.) and then stirred for one minute, and thereafter, it was confirmed that the scattered light intensity was stable to perform the measurement.

[Volume Average Particle Size of Carrier Core Material]

Thickness of a resin coating layer is overwhelmingly small as compared with a particle size of a carrier core material. Therefore, a volume average particle size of a resin-coated carrier was used as a volume average particle size of a carrier core material.

[Volume Average Particle Size of Toner]

In a 100 mL beaker, 20 mL of an aqueous solution (electrolyte solution) having 1% sodium chloride (primary) was put, and to the solution, 0.5 mL of an alkyl benzene sulfonate (dispersing agent) and 3 mg of a toner sample were successively added, then the mixture was dispersed ultrasonically for 5 minutes. The aqueous solution having 1% sodium chloride (primary) was added to the mixture so that the total amount was 100 mL, the resultant mixture was ultrasonically dispersed for 5 minutes again to thereby obtain a measurement sample. With respect to the measurement sample, the volume average particle size was calculated by COULTER COUNTER TA-III (product name, manufactured by Eeckman Coulter, Inc.) under the conditions that the aperture diameter was 100 μm and that the particle size to be measured was 2 to 40μm for each particle.

[Total Surface Area of Resin-Coated Carrier]

Specific gravity of the resin-coated carrier was set to 4.7, and the total surface area of the carrier was determined from the weight of the resin-coated carriers to be mixed based on the particle size which had been obtained by Microtrac MT3000 (trade name, manufactured by NIKISO CO., LTD.)

[Total Projected Area of Toner]

Specific gravity of the toner was set to 1.2, and the number of the toners relative to the weight of the toners to be mixed was counted based on the volume average particle size obtained by the Coulter counter: COULTER COUNTER MULTISIZER II (trade name, manufactured by Beckman Coulter, Inc.), and the number of the toners was multiplied by the area of the toners (which was obtained based on the assumption that the area is a circle) to thus obtain a total projected area of the toner.

[Diameter of Pore of Carrier Core Material]

Using an electron microscope (trade name: V9500, manufactured by Keyence Corporation), a carrier core material was enlarged and observed at 10,000-fold magnification, and an area having a radius of ½ from the center of the carrier core material in a plan view was trimmed. A contour of a pore of the carrier core material in the area was extracted and analyzed by an image analysis software "A-ZO-KUN" (manufactured by Asahi Kasei Engineering Corporation). In this way, a diameter of a pore of the carrier core material was calculated. Preparation methods of a resin-coated carrier and a toner, contained in the developers used in Examples and Comparative Examples are described below.

<Preparation of Resin-Coated Carrier>

Example 1

[Weighing Step and Mixing Step]

Finely pulverized $Fe_2O_3$ and $MgCO_3$ were provided as raw materials of a carrier core material, weighed so as to be $Fe_2O_3$:$MgCO_3$=80:20 in molar ratio, and mixed to obtain a metal raw material mixture. Polyethylene resin particles (trade name: LE-1080, manufactured by Sumitomo Seika Chemicals Co., Ltd.) having a volume average particle size of 5 μm in an amount corresponding to 10 wt % of all raw materials of a carrier core material, an ammonium polycarbonate dispersant in an amount corresponding to 1.5 wt % of all raw materials of a carrier core material, SN Wet 980 (wetting agent, manufactured by San Nopco Limited) in an amount corresponding to 0.05 wt % of all raw materials of a carrier core material, and polyvinyl alcohol (binder) in an amount corresponding to 0.02 wt % of all raw material of a carrier core material were added to water to prepare an aqueous solution.

[Pulverization Step]

The metal raw material mixture was introduced into the aqueous solution, and stirred to obtain slurry having a concentration of 75 wt %. The slurry was wet pulverized with a wet ball mill, and stirred for a while until a volume average particle size is 1 μm.

[Granulation Step]

The slurry was sprayed with a spray drier to obtain a dried granulated product having a volume average particle size of from 10 to 200 μm. Coarse particles were separated from the granulated product using a sieve mesh having a mesh size of 61 μm.

[Calcination Step]

The dried granulated product was heated at 900° C. in the atmosphere to calcine the product, thereby decomposing resin particle component. Thus, a calcined product was obtained.

[Firing Step]

The calcined product was fired at 1160° C. for 5 hours in a nitrogen atmosphere to form ferrite. Thus, a fired product was obtained.

[Crushing Step and Classification Step]

The fired product was crushed with a hammer mill, fine powder was removed using a wind power classifier, and a particle size was adjusted with a vibration sieve having a mesh size of 54 μm. Thus, a carrier core material was obtained. A diameter of a pore of the carrier core material was 0.6 μm.

[Coating Step]

The carrier core material and acrylic resin particles (trade name: MP 5500, volume average particle size: 0.4 μm, manufactured by Soken Chemical & Engineering Co., Ltd.) as coating resin particles were mixed in the proportion of carrier core material:acrylic resin particles=97:3 in weight ratio, and the resulting mixture was introduced into SPARTANRYOZER, and stirred. Temperature was increased with progress of the stirring. After the temperature in the apparatus reached 80° C., the stirring was further continued for 60 minutes. By this treatment, acrylic resin particles were adhered to the surface of the carrier core material in the proportion of 3.0 wt % based on the weight of the carrier core material, and were formed into a film. The carrier core material on which acrylic resin particles were formed into a film was inputted into a hot air circulation type heating apparatus, and heated at 200° C. for 1 hour to cure the film acrylic resin particles which were formed into a film. Thus, a resin-coated carrier of Example 1 was obtained.

Example 2

A resin-coated carrier of Example 2 was obtained in the same manner as in Example 1, except for using silicone resin particles having an average particle size of 2.4 μm (trade name: TOSPEARL 120, manufactured by GE Toshiba Silicone Co., Ltd.) which are a resin containing silicone, in place of the polyethylene resin particles at the mixing step, and conducting the firing at a temperature of 1180° C. at the firing step. A diameter of a pore of the carrier core material of Example 2 was 0.5 μm.

Example 3

[Weighing Step and Mixing Step]

Finely pulverized $Fe_2O_3$ and $Mg(OH)_2$ were provided as raw materials of a carrier core material, weighed so as to be $Fe_2O_3$:$Mg(OH)_2$=80:20 in molar ratio, and mixed to obtain a metal raw material mixture. Silica particles having a volume average particle size of 4 μm (trade name: SINRON M500, manufactured by SIBELCO) in an amount corresponding to 20 wt % of all raw materials of a carrier core material, an ammonium polycarbonate dispersant in an amount corresponding to 1.5 wt % of all raw material of a carrier core material, SN Wet 980 (wetting agent, manufactured by San Nopco Limited) in an amount corresponding to 0.05 wt % of all raw materials of a carrier core material, and polyvinyl alcohol (binder) in an amount corresponding to 0.02 wt % of all raw materials of a carrier core material were added to water to prepare an aqueous solution.

[Pulverization Step]

The metal raw material mixture was introduced into the aqueous solution, and stirred to obtain slurry having a concentration of 75 wt %. The slurry was wet pulverized with a wet ball mill, and stirred for a while until a volume average particle size is 1 μm.

[Granulation Step]

The slurry was sprayed with a spray drier to obtain a dried granulated product having a particle size of 10 μm to 200 μm. Coarse particles were separated from the dried granulated product using a sieve mesh having a mesh size of 61 μm.

[Firing Step]

The calcined product was fired at 1150° C. for 5 hours in a nitrogen atmosphere to form ferrite. Thus, a fired product was obtained.

[Crushing Step and Classification Step]

The fired product was crushed with a hammer mill, fine powder was removed using a wind power classifier, and a particle size was adjusted with a vibration sieve having a mesh size of 54 μm. Thus, a carrier core material was obtained. A diameter of a pore of the carrier core material was 0.7 μm.

[Coating Step]

The carrier core material and acrylic resin particles as coating resin particles (trade name: MP 5500, volume average particle size: 0.4 μm, manufactured by Soken Chemical & Engineering Co., Ltd.) were mixed in the proportion of carrier core material:acrylic resin particles=97:3 in weight ratio, and the resulting mixture was introduced into SPARTANRYUZER, and stirred. Temperature was increased with progress of the stirring. After the temperature in the apparatus reached 80° C., the stirring was further continued for 60 minutes. By this treatment, acrylic resin was adhered to the surface of the carrier core material in the proportion of 3.0 wt % based on the weight of the carrier core material, and was formed into a film. The carrier core material on which acrylic resin was formed into a film was inputted into a hot air circulation type heating apparatus, and heated at 200° C. for 1 hour to cure the acrylic resin which was formed into a film. Thus, a resin-coated carrier of Example 3 was obtained.

Example 4

[Carrier Core Material Preparation Step]

The carrier core material was prepared in the same manner as in Example 1.

[First Coating Step]

The carrier core material and acrylic resin particles (trade name: MP-1600, volume average particle size: 0.8 μm, manufactured by Soken Chemical & Engineering Co., Ltd.) as the first resin particles were mixed in a proportion of carrier core material:acrylic resin particles=100:0.5 in weight ratio, and introduced into SPARTANRYUZER, followed by stirring. The temperature in the apparatus was increased with the progress of stirring, and after reaching the temperature in the apparatus to 80° C., stirring was conducted for 60 minutes. By this, the acrylic resin particles as the first resin was adhered to the surface of the carrier core material in a proportion of 0.5 wt % based on the weight of the carrier core material. Thus, a first resin particle-adhered carrier core material was obtained.

[Second Coating Step]

The first resin particle-adhered carrier core material and acrylic resin particles (trade name: MP-5500, volume average particle size: 0.4 μm, manufactured by Soken Chemical & Engineering Co., Ltd.) as the second resin particles were mixed in a proportion of carrier core material:acrylic resin particles=100:0.5 in weight ratio, and introduced into SPARTANRYUZER, followed by stirring. The temperature in the apparatus was increased with the progress of stirring, and after reaching the temperature in the apparatus to 80° C., stirring was conducted for 60 minutes. By this, the acrylic resin as the second resin particles was adhered to the surface of the carrier core material in a proportion of 0.5 wt % based on the weight of the carrier core material, and the first resin particles and the second resin particles were formed into a film. The carrier core material on which the first resin particles and the second resin particles were formed into a film was inputted into a hot air circulation type heating apparatus, and heated at 200° C. for 1 hour to cure the first and second resin particles which were formed into a film. Thus, a resin-coated carrier core material of Example 4 was obtained.

Example 5

[Carrier Core Material Preparation Step, First Coating Step and Second Coating Step]

The carrier core material on which the coating layer was formed was prepared in the same manner as in Example 4.

[Outermost Shell Layer Formation Step]

The carrier core material on which the coating layer was formed and acrylic resin particles (trade name: FS501, volume average particle size: 0.5 μm, manufactured by NIPPON PAINT Co., Ltd.) as the third resin particles were mixed in a proportion of carrier core material:acrylic resin particles=100:1 in weight ratio, and introduced into SPARTANRYUZER, followed by stirring. The temperature in the apparatus was increased with the progress of stirring, and after reaching the temperature in the apparatus to 80° C., stirring was conducted for 60 minutes. By this, the acrylic resin as the third resin particles was adhered to the surface of the carrier core material on which the coating layer is formed, and the third resin particles were formed into a film. The carrier core material on which the third resin particles were formed into a film was inputted into a hot air circulation type heating apparatus, and heated at 200° C. for 1 hour to cure the third resin particles which were formed into a film. Thus, a resin-coated carrier core material of Example 5 was obtained. Note that, the glass transition temperature of the third resin particles is higher than those of the first resin particles and the second resin particles.

Comparative Example 1

A resin-coated carrier of Comparative Example 1 was obtained in the same manner as in Example 1, except that the polyethylene resin particles were not added at the weighing step and mixing step, and the calcination step was not conducted.

Comparative Example 2

A carrier core material was produced in the same manner as in Example 1. The carrier core material and a resin solution of a silicone resin (trade name: SR2411, manufactured by Dow Corning Toray Co., Ltd.) dissolved in toluene were introduced into a universal mixing and stirring apparatus (manufactured by Dalton Corporation), and the surface of the carrier core material was coated with the resin by evaporating an organic solvent while stirring. The resin-coated carrier core material was fired at 200° C. for 1 hour with a hot air circulation type heating apparatus. Thus, a resin-coated carrier of Comparative Example 2 was obtained. The silicone resin was adjusted so as to have the same solid content as in the polyethylene resin particles of Example 1.

Comparative Example 3

A resin-coated carrier of Comparative Example 3 was obtained in the same manner as in Example 1, except for using acrylic resin particles having a volume average particle size of 1,0 μm (trade name: FS-301, manufactured by NIPPON PAINT Co., Ltd.) in place of the acrylic resin particles having a volume average particle size of 0.4 μm at the coating step.

Comparative Example 4

A resin-coated carrier of Comparative Example 4 was obtained in the same manner as in Example 1, except that the remanent magnetization of the carrier core material was adjusted to 11 emu/g by changing the temperature during the firing in the firing step.

Properties of the carrier core materials used in the production of the resin-coated carriers of Examples and Comparative Examples, and the state of the resin coating layers are shown in Table 1. The state of the resin coating layer was observed with SEM as to whether or not the resin coating layer is sufficiently formed on the surface of the carrier core material.

<Preparation of Toner>

Four kinds of toners (Toner (1) to Toner (a)) were prepared as follows.

Toner (1)

| | |
|---|---|
| Polyester resin (acid value: 21 mgKOH/g, aromatic alcohol component: PO-BPA and EP-BPA, acid component: fumaric acid and trimellitic anhydride) | 87.5% by weight |
| C.I. Pigment Blue 15:1 | 5% by weight |
| Nonpolar paraffin wax (DSC peak 78° C., weight average molecular weight (Mw): $8.32 \times 10^2$) | 6% by weight |
| Charge control agent (trade name: BONTRON E-84, manufactured by Orient Chemical Industries Co., Ltd.) | 1.5% by weight |

The above constituent materials were premixed with a Henschel mixer, and melt-kneaded with a twin-screw extrusion kneader to obtain a kneaded material. The kneaded material was coarsely pulverized with a cutting mill, and finely pulverized with a jet mill. The resulting mixture was then classified with a wind power classifier. Thus, toner base particles having a volume average particle size of 6.5 μm were prepared. To 97.8% by weight of the toner base particles classified, 1.2% by weight of silica which was hydrophobicized with i-butyl trimethoxysilane and had a primary particle size of 0.1 μm, and 1.0% by weight of silica fine particles which were hydrophobicized with HMDS and had a primary particle size of 12 nm, were added, and the resulting mixture was mixed with a Henschel mixer, and was subjected to external addition process. Thus, Toner (1) was prepared.

Toner (2)

Toner (2) was prepared in the same manner as in Toner (1), except for using carbon black in place of C.I. Pigment Blue 15:1.

Toner (3)

Toner (3) was prepared in the same manner as in the Toner (1), except for using a charge control agent (trade name: LR-147, Japan Carlit Co., Ltd.) in place of the charge control agent (trade name: E-81). There is no great difference in properties between the charge control agent (trade name: E-81) and the charge control agent (trade name: LR-147, Japan Carlit Co., Ltd.), but the charge control agent (trade name: E-81) has slightly faster rise of charging.

Toner (4)

Toner (4) was prepared in the same manner as in the Toner (1), except that the hydrophobicized silica having a volume average particle size of 0.1 μm was not externally added.

<Preparation of Two-Component Developer>

Each of the resin-coated carriers of Examples and Comparative Examples and each of the toners obtained above were mixed in a weight ratio such that the proportion of the total

TABLE 1

| | | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|---|
| Carrier core material | Apparent density ($g/cm^3$) | 1.7 | 1.8 | 1.6 | 2.0 | 1.7 | 2.4 | 1.7 | 1.7 | 1.9 |
| | Remanent magnetization (emu/g) | 6.5 | 7.2 | 9.2 | 8.0 | 6.5 | 4.2 | 6.5 | 6.5 | 11 |
| | Volume average particle size (μm) | 45 | 50 | 35 | 27 | 45 | 45 | 45 | 45 | 43 |
| State of resin coating layer | | Good | Good | Good | Good | Good | Good | Poor | Poor | Good |

projected area of the toners to the total surface area of the resin-coated carriers is 70%, respectively. The resin-coated carriers in the total weight of 300 g and the toner were mixed in a container made of polyethylene, and then mixed by stirring with a roll mill for 1 hour. Thus, two-component developers were prepared.

<Evaluation>

The following evaluations were conducted using the above two-component developers.

[Initial Charging Property]

The two-component developers were set in a copying machine (modified from MX-6200N of Sharp Corporation) having a two-component developing device therein. After the copying machine was rotated at idle for 3 minutes at normal temperature and normal humidity, and the two-component developers were collected. The charge amount of each of the two-component developers was measured with a suction type charge amount measuring apparatus (trade name: 210H-2A Q/M Meter, manufactured by TREK Inc.)

Evaluation standard of the initial charging property is as follows.

Good: Favorable. Charge amount is −25 μC/g or more.

Not bad: Available. Charge amount is −20 μC/g or more and less than −25 μC/g.

Poor: No good. Charge amount is less than −20 μC/g.

[Image Property]

Using an apparatus in which a developing device of the copying machine (trade name: MX-6200N, manufactured by Sharp Corporation) was modified, and the developers obtained above, fine line was printed by adjusting such that line width is 400 μm, and an image on a photoreceptor was transferred to a cellophane tape. The presence or absence of voids in transferred image and toner scattering (fog) were observed with an optical microscope, and the evaluation was made by the following evaluation standards.

Evaluation standard of image property regarding deficient image is as follows.

Excellent: Very favorable. No void is observed in the image.

Good: Favorable. Three or less voids are observed in the image.

Not bad.: Available. Four to six voids are observed in the image.

Poor: No good. Seven or more voids are observed in the image.

Evaluation standard of image property regarding toner scattering is as follows.

Good: Favorable. Toner scattering cannot almost be verified.

Not bad: Available. Toner scattering can slightly be verified, but is practically no problem.

Poor: No good. Toner scattering can clearly be verified.

[Attenuation Property of Charge Amount]

In a 100 ml polyethylene container, 76 g of developers formed with the resin-coated carriers and 4 g of the Loners prepared in the Examples and the Comparative Examples were contained. After each of the developers was stirred with a 150 rpm ball mill for 60 minutes, the charge amounts of the developers were measured. The developers were then exposed to high temperature and high humidity. The developers of 1 day after, 3 days after and 10 days after were stirred under the same conditions, and the charge amounts of the developers were measured. The charge amount of the developer measured on the first day and the charge amount thereof measured 1 day after were compared, the charge amount of the developer measured 1 day after and the charge amount thereof measured 3 days after were compared, and the charge amount of the developer measured 3 days after and the charge amount thereof measured 10 days after were compared. Attenuation property of the charge amount was evaluated by the difference in the charge amount (difference in attenuation charge amount) having the largest change among the difference between the charge amount of the developer measured on the first day and the charge amount thereof measured 1 day after, the difference between the charge amount of the developer measured 1 day after and the charge amount thereof measured 3 days after, and the difference between the charge amount of the developer measured 3 days after and the charge amount thereof measured 10 days after.

Evaluation standard of attenuation property of charge amount is as follows.

Good: Favorable. Difference in attenuation charge amount is 5 μC/g or less in absolute value.

Not bad: Available. Difference in attenuation charge amount exceeds 5 μC/g and is 7 μC/g or less in absolute value.

Poor: No good. Difference in attenuation charge amount exceeds 7 μC/g in absolute value.

[Life Property]

The two-component developers were set in a copying machine (MX-6000N, manufactured by Sharp Corporation) having a two-component developing device therein. After 50,000 prints of solid image were produced at normal temperature and normal humidity, the image density in the image area, the whiteness in the non-image area, and the life charge amount of the developers were measured. The image density was measured with an X-Rite 938 spectrodensitometer. Regarding the whiteness, the tristimulus values X, Y and Z were obtained using an SZ90 spectral color difference meter manufactured by Nippon Denshoku Kogyo Co., Ltd. The initial and life charge amounts of the two-component developers were measured with a suction type charge amount measuring apparatus.

The evaluation standard of the image density is as follows.

Good: Favorable. Image density is 1.4 or more.

Poor: No good. Image density is less than 1.4.

The evaluation standard of the whiteness is as follows.

Good: Favorable, Z value is 0.5 or less.

Not bad: Available. Z value exceeds 0.5 and is 0.7 or less.

Poor: No good. Z value exceeds 0.7.

The evaluation standard of the life charging property of the two-component developers is as follows.

Good: Favorable. Difference in charge amount between "initial" and "life" (hereinafter referred to as "life charge amount difference") is 5 μC/g or less in absolute value.

Not bad: Available. Difference in charge amount between "initial" and "life" exceeds 5 μC/g and is 7 μC/g or less in absolute value.

Poor: No good. Difference in charge amount between "initial" and "life" exceeds 7 μC/g in absolute value.

[Measurement of Torque]

The torque was measured using a developing device of the copying machine (trade name: MX-6200N, manufactured by Sharp Corporation).

The evaluation standard of the measurement of torque is as follows.

Good: Favorable. The value of torque is 12.5 g·cm or less.

Poor: No good. The value of torque exceeds 12.5 g·cm.

[Comprehensive Evaluation]

The comprehensive evaluation standard using the above evaluation results is as follows.

Good: Favorable. Evaluation results of the evaluations are rated as "Excellent", "Good" or "Not bad".

Poor: No good. Evaluation results of the above evaluations include "Poor".

The kind of the toners used in the two-component developers, the evaluation results of the above evaluations, and the comprehensive evaluation results are shown in Table 2.

TABLE 2

| | | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|---|
| Kind of toner | | Toner (1) | Toner (2) | Toner (3) | Toner (4) | Toner (2) | Toner (1) | Toner (2) | Toner (3) | Toner (2) |
| Initial charging property | Charge amount (μC/g) | 28 | 26 | 30 | 31 | 27 | 29 | 35 | 19 | 28 |
| | Evaluation | Good | Good | Good | Good | Good | Good | Good | Poor | Good |
| Image property | Void | Excellent | Good | Excellent | Excellent | Good | Poor | Poor | Poor | Poor |
| | Toner scattering | Good | Good | Good | Good | Good | Not bad | Good | Poor | Good |
| Attenuation property of charge amount | Difference in attenuation charge amount (μC/g) | 5 | 3 | 5 | 3 | 4 | 7 | 10 | 11 | 7 |
| | Evaluation | Good | Good | Good | Good | Good | Not bad | Poor | Poor | Not bad |
| Life property | Image density | 1.5 | 1.4 | 1.6 | 1.5 | 1.4 | 1.5 | 1.3 | 1.6 | 1.5 |
| | Evaluation | Good | Good | Good | Good | Good | Good | Poor | Good | Good |
| | Whiteness | 0.5 | 0.6 | 0.4 | 0.5 | 0.5 | 0.5 | 0.4 | 0.8 | 0.5 |
| | Evaluation | Good | Not bad | Good | Good | Good | Good | Good | Poor | Good |
| | Life charge amount difference (μC/g) | 3 | 4 | 6 | 3 | 7 | 9 | 10 | 12 | 7 |
| | Evaluation | Good | Good | Not bad | Good | Not bad | Poor | Poor | Poor | Not bad |
| Measurement of torque | Torque (g · cm) | 10.8 | 11.2 | 10.2 | 11.5 | 11.8 | 13 | 12 | 11.2 | 12.8 |
| | Evaluation | Good | Good | Good | Good | Good | Poor | Good | Good | Poor |
| Comprehensive evaluation | | Good | Good | Good | Good | Good | Poor | Poor | Poor | Poor |

It is found from Table 2 that the resin-coated carrier comprising the carrier core material having an apparent density of 2.0 g/cm$^3$ or less, a remanent magnetization of 10 emu/g or less and a volume average particle size of 25 μm or more and 50 μm or less, and resin particles with which the surface of the carrier core material is dry-coated by heat and impact force, shows good result.

In the evaluation of the initial charging property, Example 3 using the charge control agent (LR-147) shows the charge amount larger than that of Example 1 using ,he charge control agent (E-81), and obtained better result. The charge control agent (E-81) gives the rise of charging slightly faster than that of the charge control agent (LR-147) as described before. It is therefore found from the this result that the carrier of Example 3 prepared by the silica particle addition method is excellent in the initial rise property of charging as compared with the carrier of Example 1 prepared by the resin addition method.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for producing a resin-coated carrier, comprising:

a coating step of forming a coating layer by mixing a carrier core material having pores, an apparent density of 1.6 g/cm$^3$ or more and 2.0 g/cm$^3$ or less and a remanent magnetization of 10 emu/g or less, and resin particles having a volume average particle size of less than 1 μm, and applying impact force to the resulting mixture while stirring the mixture under heating, thereby adhering the resin particles to a surface of the carrier core material and forming a film of the resin particles to produce the resin-coated carrier comprising the carrier core material having pores, and the film of the resin particles which covers the surface of the carrier core material so as not to enter the pores.

2. The method of claim 1, wherein the resin particles comprise first resin particles and second resin particles having a volume average particle size smaller than that of the first resin particles, and the coating step comprises:

a first coating step of obtaining a first resin particle-adhered carrier core material by mixing the carrier core material and the first resin particles and applying impact force to the resulting mixture while stirring the mixture under heating, thereby adhering the first resin particles to the surface of the carrier core material; and a second coating step of forming a coating layer by mixing the first resin particle-adhered carrier core material and the second resin particles and applying impact force to the resulting mixture while stirring the mixture under heating, thereby adhering the second resin particles to a surface of the first resin particle-adhered carrier core material and forming a film of the first resin particles and the second resin particles on the surface of the carrier core material.

3. The method of claim 1, comprising an outermost shell layer formation step of forming an outermost shell layer by adhering third resin particles having a glass transition temperature higher than that of the resin particles used at the coating step and forming a film of the third resin particles as a step after the coating step.

* * * * *